US008364051B2

(12) United States Patent
Sakaya et al.

(10) Patent No.: US 8,364,051 B2
(45) Date of Patent: Jan. 29, 2013

(54) FIXING DEVICE AND IMAGE FORMING APPARATUS INCLUDING SAME

(75) Inventors: Kohta Sakaya, Osaka (JP); Yoshihiro Fukuhta, Hyogo (JP); Tamotsu Ikeda, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 379 days.

(21) Appl. No.: 12/659,648

(22) Filed: Mar. 16, 2010

(65) Prior Publication Data

US 2010/0239297 A1 Sep. 23, 2010

(30) Foreign Application Priority Data

Mar. 17, 2009 (JP) ..... 2009-064987
Mar. 18, 2009 (JP) ..... 2009-066259

(51) Int. Cl.
*G03G 15/20* (2006.01)

(52) U.S. Cl. ..... 399/69

(58) Field of Classification Search ..... 399/69, 399/122, 320, 322, 328, 330, 331, 333, 334
See application file for complete search history.

(56) References Cited

U.S. PATENT DOCUMENTS 5,130,754 A * 7/1992 Hishikawa ..... 399/322
5,450,181 A * 9/1995 Tsukida et al. ..... 399/322
5,579,097 A * 11/1996 Tomoe et al. ..... 399/323
5,737,679 A * 4/1998 Uehara et al. ..... 399/329
7,664,447 B2 2/2010 Yagi et al.
2005/0252912 A1* 11/2005 Yamamoto ..... 219/619
2007/0059004 A1* 3/2007 Kang ..... 399/45
2007/0223976 A1 9/2007 Yagi et al.
2008/0013992 A1 1/2008 Fukuhata et al.
2008/0013993 A1 1/2008 Obata et al.
2008/0031664 A1 2/2008 Yagi et al.
2008/0063442 A1 3/2008 Yagi et al.
2008/0069611 A1 3/2008 Obata et al.
2009/0110449 A1 4/2009 Saito et al.

(Continued)

FOREIGN PATENT DOCUMENTS

JP 2001-265146 9/2001
JP 2004-109697 4/2004

(Continued)

OTHER PUBLICATIONS

Machine translation of reference Hayamizu et al. (JP 2005-352,297 A), Pub date Dec. 22, 2005.*

*Primary Examiner* — Walter L Lindsay, Jr.
*Assistant Examiner* — Rodney Bonnette
(74) *Attorney, Agent, or Firm* — Harness, Dickey & Pierce, P.L.C.

(57) ABSTRACT

A fixing device includes a cylindrical fixing member, having an external circumferential surface including a crown portion curved radially outward and a inverted-crown portion curved radially inward, a pressing unit including a convexity and a concavity formed on a facing surface facing the fixing member, a first heating member to heat the fixing member, corresponding to the crown portion of the fixing member, a second heating member to heat the fixing member, corresponding to the inverted-crown portion of the fixing member, a temperature detector to detect a surface temperature of the fixing member, and a controller to control the first heating member and the second heating member independently. The pressing unit presses against the fixing member while the crown portion and the inverted-crown portion of the fixing member match the concavity and the convexity of the pressing unit, respectively, forming a curved fixing nip therebetween.

20 Claims, 26 Drawing Sheets

U.S. PATENT DOCUMENTS

| | | | | |
|---|---|---|---|---|
| 2009/0129836 | A1 | 5/2009 | Sakaya et al. | |
| 2009/0190949 | A1 | 7/2009 | Hamahashi et al. | |
| 2009/0238585 | A1 | 9/2009 | Hayashi et al. | |
| 2010/0178089 | A1* | 7/2010 | Fukuhata | 399/333 |
| 2010/0272481 | A1* | 10/2010 | Yamamoto et al. | 399/328 |
| 2010/0296848 | A1* | 11/2010 | Yamamoto et al. | 399/328 |
| 2011/0052285 | A1* | 3/2011 | Fukuhata | 399/333 |
| 2012/0020690 | A1* | 1/2012 | Yamamoto et al. | 399/69 |

FOREIGN PATENT DOCUMENTS

| | | |
|---|---|---|
| JP | 2005-284089 | 10/2005 |
| JP | 2008-020821 | 1/2008 |

* cited by examiner

FIXING DEVICE AND IMAGE FORMING APPARATUS INCLUDING SAME

CROSS-REFERENCE TO RELATED APPLICATIONS

This patent specification is based on and claims priority from Japanese Patent Application Nos. 2009-064987, filed on Mar. 17, 2009 and 2009-066259, filed on Mar. 18, 2009 in the Japan Patent Office, the contents of which are hereby incorporated by reference herein in its entirety.

BACKGROUND OF THE INVENTION

1. Field of the Invention

The present invention generally relates to a fixing device to fix an image on a sheet of recording media, and an image forming apparatus, such as a copier, a printer, a facsimile machine, or a multifunction machine capable of at least two of these functions, including the fixing device.

2. Discussion of the Background Art

Image forming apparatuses, such as, printers, facsimile machines, plotters, or multifunction machines including at least two of these functions, typically include a fixing device to fix toner images on sheets of recording media with heat and pressure (e.g., a heat-type fixing device). Fixing devices generally include a fixing member, a heat source configured to heat the fixing roller, and a pressing member configured to press against the fixing member. There are roller-fixing type fixing devices, in which both the fixing member and the pressure member are rollers, and belt-fixing type fixing devices, in which at least one of the fixing member and the pressure member is an endless belt. In fixing devices, the toner image on the sheet is fused with the heat from the fixing, member and then is fixed with the pressure generated between the fixing member and the pressing member while the sheet passes through a so-called fixing nip, where the pressure member presses against the fixing member.

FIG. 1 is a schematic end-on cross-sectional diagram illustrating a known heat-type fixing device including a fixing roller 100 and a pressing roller 200 pressing against the fixing roller 100.

As shown in FIG. 1, a sheet P (e.g., a recording medium) on which a toner image T is formed passes through a fixing nip N and then is discharged in a direction indicated by alternate long and short dashed arrow a. However, in this type of fixing devices, the actual direction in which the sheet P is discharged from the fixing device (sheet discharge direction) tends to shift from the direction indicated by arrow a toward the fixing roller 100 because the fused toner T adheres to the fixing roller 100 and pulls the sheet P toward the fixing roller 100. If the adhesion force of the fused toner T to the fixing roller 100 causes the sheet discharge direction to shift across a threshold line indicated by line b (threshold line b) to one side (in FIG. 1, to the left), it can happen that the sheet P winds around the fixing roller 100.

More specifically, if F1 and F2 respectively represent the adhesion force of the fused toner T to the fixing roller 100 and a force required to bend the sheet P by an angle θ from the direction indicated by arrow a to the threshold line b to wind around the fixing roller 100, then the sheet P can be separated from the fixing roller 100 when a relation F1<F2 is satisfied. Put simply, the sheet P separates cleanly from the fixing roller 100 and is discharged properly so long as the force of adhesion of the fused toner T to the fixing roller 100 is not enough to overcome the sheet P's stiffness and wrap the sheet P around the fixing roller 100. The threshold line b is the border of the angle θ at which the sheet P, if bent, winds around the fixing roller 100.

In view of the foregoing, several approaches have been tried to facilitate separation of the sheet from the fixing roller. For example, releasing agent such as wax may be added to the toner to reduce the adhesion force of the toner. Alternatively, the diameter of the fixing roller is reduced as indicated by a chain double-dashed line shown in FIG. 1 to shift the threshold line b to a threshold line b' shown in FIG. 1, thereby increasing the force F2 required to bend the sheet P (bending force F2) to the angle at which the sheet P winds around the fixing roller 100.

However, the above-described known approaches cannot prevent the sheet from winding around the fixing roller when the sheet is relatively thin and has a lower degree of stiffness because the bending force F2 required to cause the sheet to wind around the sheet is also smaller. Additionally, although the sheet discharge direction may be adjusted by a guide member, the image may be disturbed and/or the sheet may wrinkle if the image face (that side of the sheet on which the toner image is formed) of the sheet contacts the guide member.

Therefore, there is a need for a fixing device capable of facilitating separation of the sheet from the fixing member as well as preventing disturbance of images and/or creation of wrinkles on the sheet, which known approaches fail to do.

SUMMARY OF THE INVENTION

In view of the foregoing, in one illustrative embodiment of the present invention provides a fixing device to fix a toner image on a sheet of recording media. The fixing device includes a cylindrical fixing member, a pressing unit pressing against the fixing member, a first heating member including a first heating portion to heat the fixing member partially in an axial direction of the fixing member, a second heating member including a second heating portion to heat the fixing member partially in the axial direction of the fixing member, a temperature detector to detect a surface temperature of the fixing member, and a controller to independently control the first heating member and the second heating member.

An external circumferential surface of the fixing member includes at least one crown portion projecting outward in a direction of diameter and at least one inverted-crown portion curved inward in the direction of diameter, having a thickness smaller than a thickness of the crown portion, arranged in the axial direction. The pressing unit includes a facing surface facing the fixing member, and at least one convexity projecting toward the fixing member and at least one concavity recessed away from the fixing member are formed on the facing surface. The fixing member and the pressing unit press against each other with the crown portion of the fixing member fitted in the concavity of the pressing unit and the inverted-crown portion of the fixing member matches the convexity of the pressing unit, and thus a curved fixing nip is formed therebetween. The first heating portion is disposed at a position corresponding to the crown portion of the fixing member in the axial direction, and the second heating portion is disposed at a position corresponding to the inverted-crown portion of the fixing member in the axial direction.

In another illustrative embodiment of the present invention, a fixing device includes the fixing member described above, the pressing unit described above, pressing against the fixing member, forming a fixing nip therebetween, a heat source to heat the fixing member, and a guide member to guide the sheet to the fixing nip, disposed upstream from the fixing nip in a sheet transport direction.

When a virtual plane passing through both an axial line of the fixing member and a center of the fixing nip in the sheet transport direction is referred to as a plane Y, and a plane perpendicular to the plane Y, passing through the center of the fixing nip in the sheet transport direction is referred to as a curve reference plane, a downstream end of a sheet facing surface of the guide member facing a sheet transport path in the sheet transport direction is closer to the pressing unit than the curve reference plan Yet another illustrative embodiment provides an image forming apparatus that includes an image carrier on which a latent image is formed, a development device to develop the latent image with developer, a transfer unit to transfer the image onto a sheet of recording media, and the fixing device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
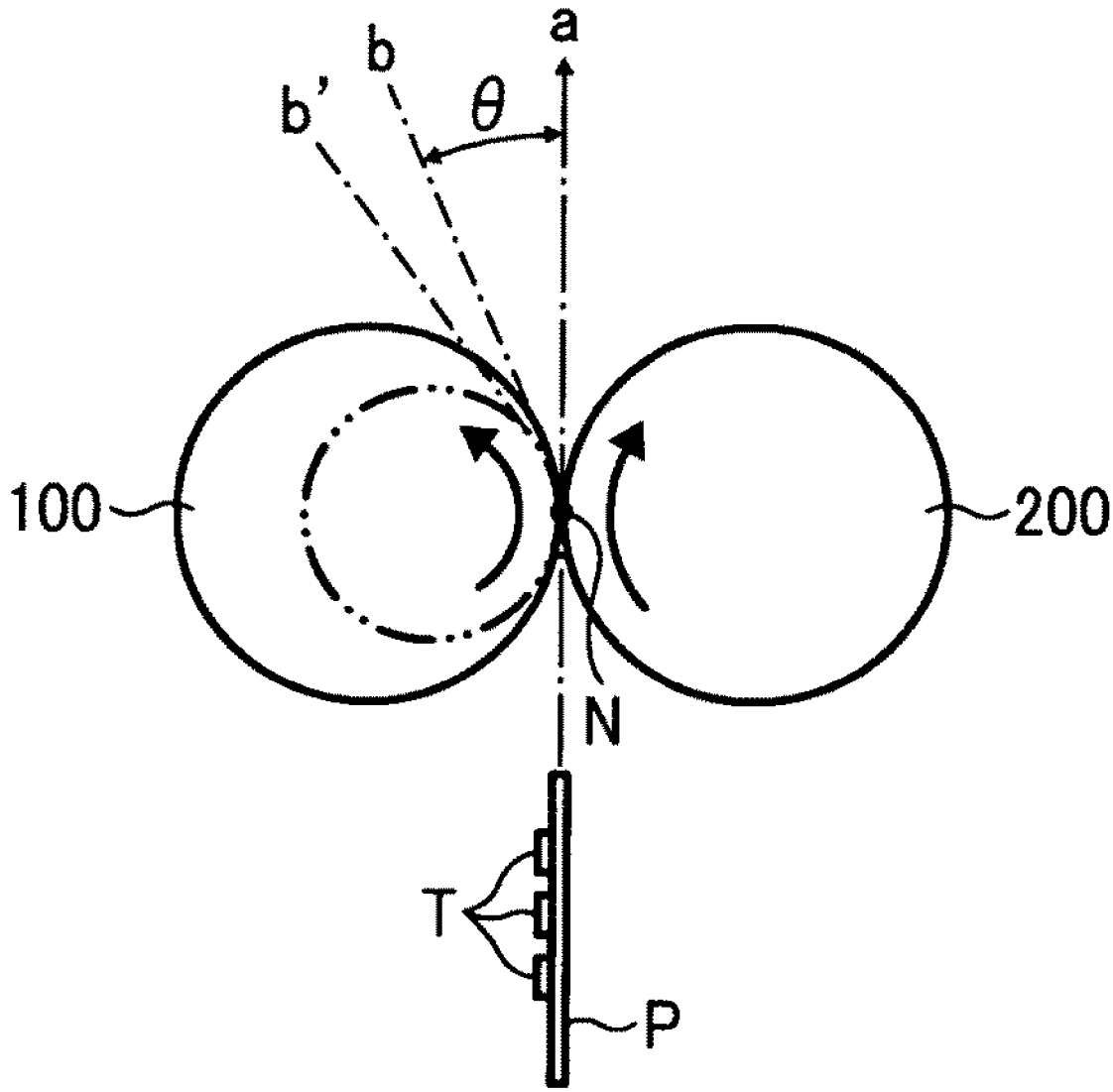
FIG. 1 BACKGROUND ART
FIG. 1 is a schematic diagram illustrating a sheet winding around a fixing roller in a background fixing device.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 2:
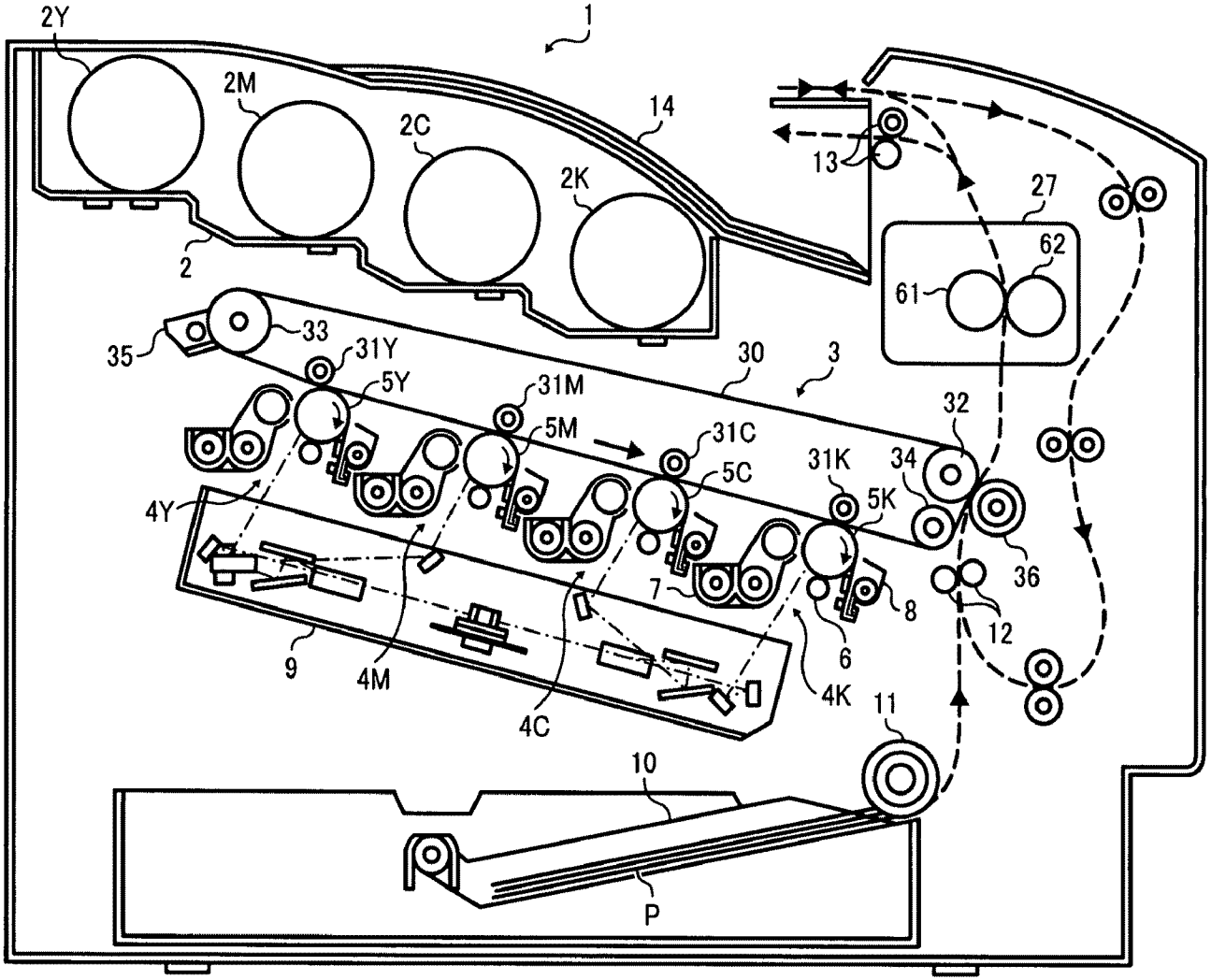
FIG. 2 is a schematic diagram illustrating a configuration of a multicolor image forming apparatus according to an illustrative embodiment of the present invention.

Referring now to the drawings, wherein like reference numerals designate identical or corresponding parts throughout the several views thereof, and particularly to FIG. 2, an image forming apparatus according to an illustrative embodiment of the present invention is described.

FIG. 2 is a schematic diagram illustrating a configuration of an image forming apparatus 1 that in the present embodiment is a tandem-type multicolor printer. The image forming apparatus 1 includes toner bottles 2Y, 2M, 2C, and 2K respectively containing yellow, magenta, cyan, and black toners, that are disposed above a main body and removably installed in a bottle container, not shown.

It is to be noted that the subscripts Y, M, C, and K attached to the end of an identical reference numeral indicate only that components indicated thereby are used for forming yellow, magenta, cyan, and black images, respectively, and hereinafter may be omitted when color discrimination is not necessary.

An intermediate transfer unit 3 including an intermediate transfer belt 30 is provided beneath the four toner bottles 2. The intermediate transfer unit 3 includes four primary-transfer bias rollers 31, a secondary-transfer backup roller 32, a cleaning backup roller 33, a tension roller 34, and a belt cleaning unit 35 in addition to the intermediate transfer belt 30. The intermediate transfer belt 30 is supported by the secondary-transfer backup roller 32, the cleaning backup roller 33, and the tension roller 34, and the secondary-transfer backup roller 32 serves as a driving roller to rotate the intermediate transfer belt 30 counterclockwise in FIG. 2 as indicated by an arrow shown in FIG. 2.

The image forming apparatus 1 further include image forming units 4Y, 4M, 4C, and 4K for forming yellow, magenta, cyan, and black toner images, respectively, that are arranged in parallel to each other, facing the intermediate transfer belt 30. Each image forming unit 4 includes a photoreceptor drum 5 as an image carriers, and a charger 6, a development device 7, a cleaning unit 8, and a discharge member, not shown, are provided around the photoreceptor drum 5. The image forming units 4Y, 4M, 4C, and 4K form different single-color images on the respective photoreceptor drums 5 through a sequence of image forming processes, a charging process, an exposure process, a development process, and a cleaning process.

Additionally, a fixing device 27 is provided downstream from a secondary-transfer roller 36 in a direction in which the sheet P is transported (sheet transport direction) and includes a fixing roller 61 and a pressing roller 62 pressing against the fixing roller 61 in the present embodiment.

The image forming apparatus 1 further includes a sheet feeding unit 10 containing multiple sheets P, disposed beneath the main body, and a feed roller 11 to feed the sheet P from the sheet feeding unit 10 to a pair of registration rollers 12.

Operation of the image forming apparatus 1 is described below with reference to FIG. 1.

The photoreceptor drums 5 are rotated clockwise in FIG. 2 by a driving motor (not shown). Initially, a surface of each photoreceptor drum 5 is charged uniformly by the charger 6 at a position facing the charger 6 (charging process). When the photoreceptor drum 5 reaches a portion to receive a laser beam emitted from an exposure unit 9 disposed beneath the image forming units 4 in FIG. 2, the photoreceptor drum 5 is scanned with the laser beam, and thus an electrostatic latent image is formed thereon (exposure process).

Then, the photoreceptor drum 5 reaches a portion facing the development device 7, where the latent image is developed with toner into a single-color toner image. When the surface of the photoreceptor drum 5 carrying the toner image reaches a portion facing the primary-transfer bias roller 31 via the intermediate transfer belt 30, the toner image is transferred therefrom onto the intermediate transfer belt 30 (primary-transfer process).

As a certain amount of toner tends to remain on the photoreceptor drum 5 after the primary-transfer process, when the surface of each photoreceptor drum 5 reaches a position facing the cleaning unit 8, a cleaning blade, not shown, of the cleaning unit 8 mechanically collects any toner remaining on the photoreceptor drum 5 in the cleaning process.

Subsequently, the discharge member, not shown, removes potentials remaining on the surface of the photoreceptor 5. Thus, a sequence of image forming processes performed on each photoreceptor drum 5 is completed. The four primary-transfer bias rollers 31 are configured to press against the corresponding photoreceptor drums 5 via the intermediate transfer belt 30, and four contact portions between the primary-transfer bias rollers 31 and the corresponding photoreceptor drums 5 are hereinafter referred to as primary-transfer nips. Each primary-transfer bias rollers 31 receives a transfer bias whose polarity is opposite the polarity of the toner. In the above-described primary-transfer process, while the intermediate transfer belt 30 rotates in the direction indicated by the arrow shown in FIG. 2, passing through the respective primary-transfer nips, the multiple single-color toner images are transferred from the respective photoreceptor drums 5 and superimposed one on another on the intermediate transfer belt 30, forming a multicolor toner image thereon. Then, the intermediate transfer belt 30 carrying the multicolor toner image reaches a portion facing the secondary-transfer roller 36 disposed facing the secondary-transfer backup roller 32.

Meanwhile, the sheets P stacked in the sheet feed unit 10 are fed from the top one at a time to the registration rollers 12 when the feed roller 11 rotates counterclockwise in FIG. 2. The registration rollers 12 stop the sheet P by sandwiching the sheet P therebetween and then forward the sheet P to the secondary-transfer nip, timed to coincide with the arrival of the multicolor toner image formed on the intermediate transfer belt 30.

The secondary-transfer backup roller 32 and the secondary-transfer roller 36 press against each other via the intermediate transfer belt 30, and the contact portion therebetween is hereinafter referred to as a secondary-transfer nip. The multicolor toner image formed on the intermediate transfer belt 30 is transferred onto a sheet P (recording medium) transported to the secondary-transfer nip (secondary-transfer process) in the secondary transfer nip. Thus, the multicolor toner image is recorded on the sheet P.

As a certain amount of toner tends to remain on the intermediate transfer belt 30 after the secondary-transfer process, when the intermediate transfer belt 30 reaches a position facing the belt cleaning unit 35, any toner remaining on the intermediate transfer belt 30 is collected by the belt cleaning unit 35. Thus, a sequence of image forming processes performed on the intermediate transfer belt 30 is completed.

Subsequently, the sheet P is transported to the fixing device 27, and the multicolor toner image is fixed on the sheet P while the sheet P passes through a fixing nip N (shown in FIG. 3), where the pressing roller 62 presses against the fixing roller 61. Then, the sheet P is discharged by a pair of discharge rollers 13 outside the apparatus and stacked on a stack portion 14 formed on an upper side of the image forming apparatus 1. Thus, a sequence of image forming processes performed in the image forming apparatus 1 is completed.

First Embodiment

A configuration of the fixing device 27 according to a first embodiment is described below with reference to FIGS. 3 through 8.

Figure 3:
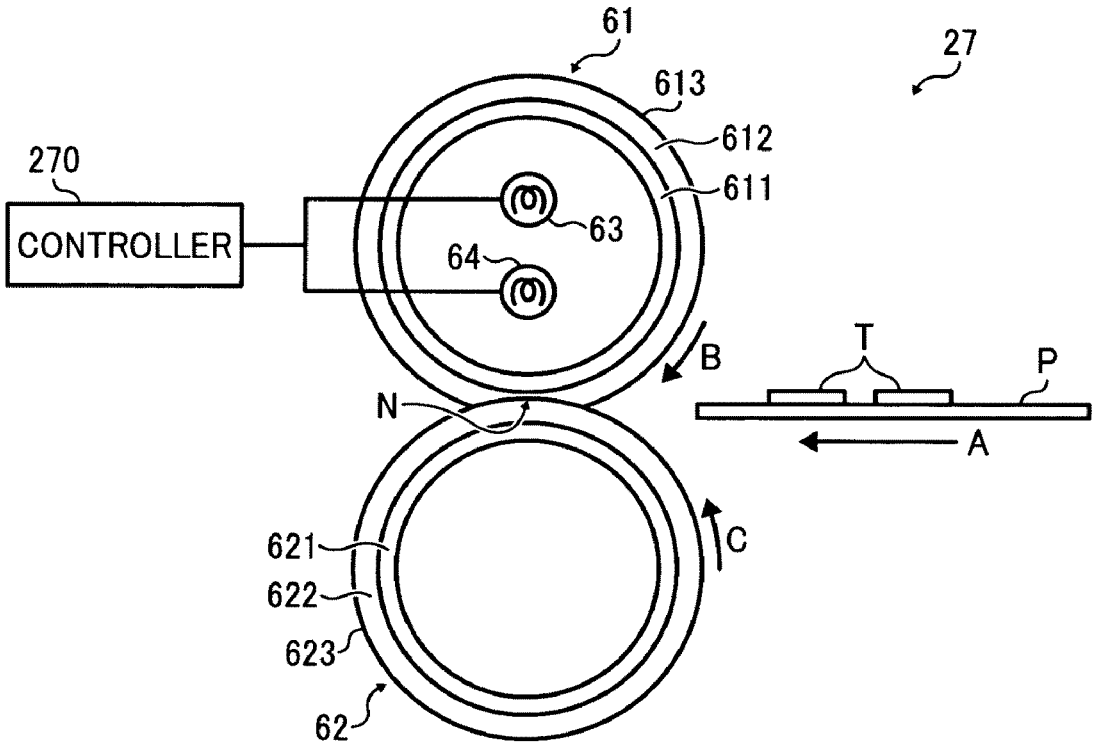
FIG. 3 is an end-on cross-sectional view illustrating a fixing device according to a first embodiment.

FIG. 3 is a cross-sectional side view illustrating the fixing device 27.

As shown in FIG. 3, the fixing device 27 includes the fixing roller 61, serving as a cylindrical fixing member, and the pressing roller 62, serving as a pressing unit, configured to press against the fixing roller 61. The fixing nip N is formed between the fixing roller 61 and the pressing roller 62 pressing against each other. A first heat lamp 63 (e.g., a first heating member) and a second heat lamp 64 (e.g., a second heating member), together forming a heat source, are provided inside the fixing roller 61. The first heat lamp 63 and the second heat lamp 64 extend in an axial direction of the fixing roller 61, which is a direction perpendicular to the surface of paper on which FIG. 3 is drawn, and the fixing roller 61 is heated with the heat generated by the first heat lamp 63 and the second heat lamp 64 controlled by a controller 270.

Controlling the first heat lamp 63 (first heating member) and the second heat lamp 64 (second heating member) independently can vary the amount of heat generated and the time period during which the heat is generated in the crown portions 61*a* from those in the inverted-crown portions 61*b*. Therefore, differences in temperature between the crown portions 61*a* and the inverted-crown portions 61*b* can be reduced, reducing unevenness in the gross of the fixed image.

The fixing roller 61 includes a cylindrical metal core 611, an elastic layer 612 lying over the metal core 611, and a release layer 613 lying over the elastic layer 612. Similarly, the pressing roller 62 includes a cylindrical metal core 621, an elastic layer 622 lying over the metal core 621, and a release layer 623 lying over the elastic layer 622.

Figure 4:
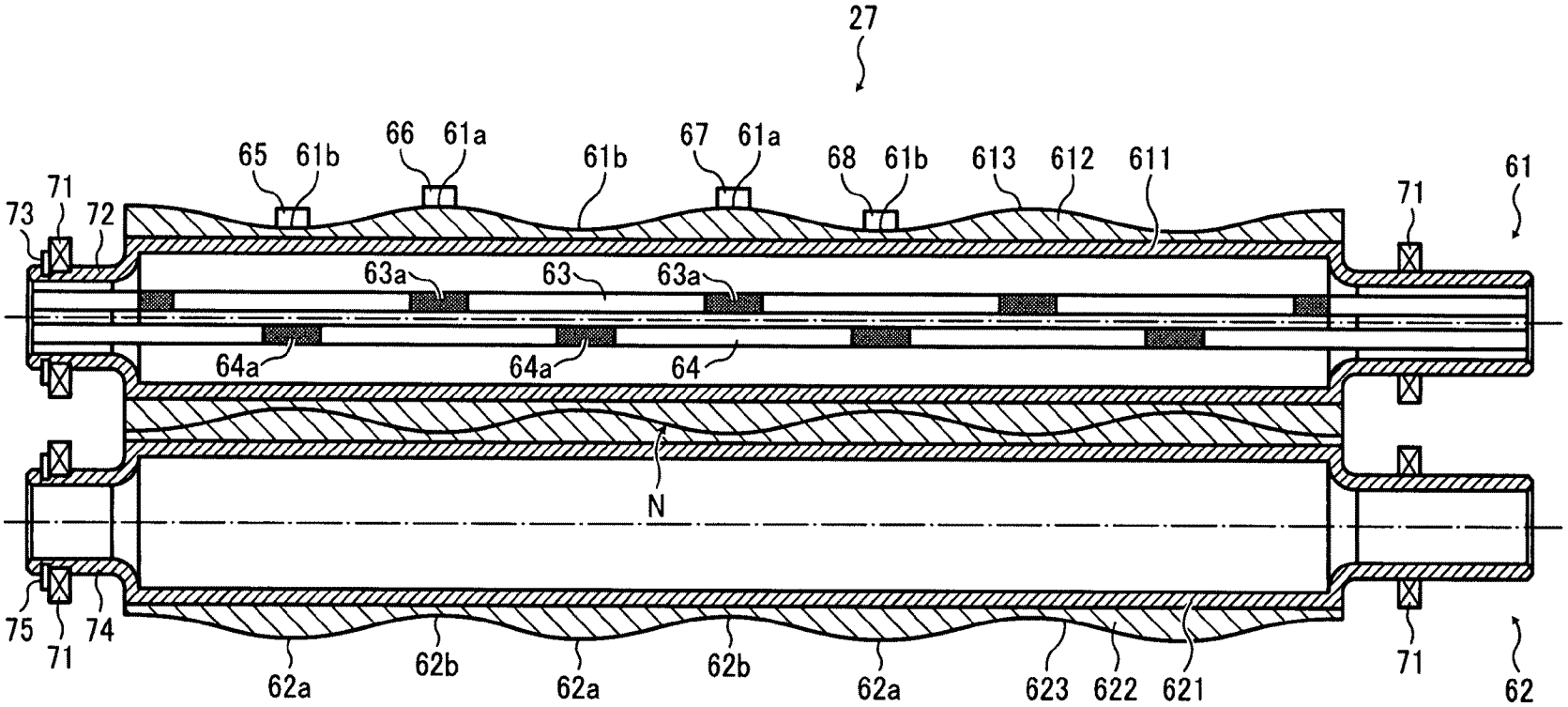
FIG. 4 is a front cross-sectional view illustrating the fixing device shown in FIG. 3.

FIG. 4 is a cross-sectional front view illustrating the fixing device 27. As shown in FIG. 4, four temperature detectors 65, 66, 67, and 68 are provided adjacent to an external circumferential surface of the fixing roller 61 to detect a surface temperature of the fixing roller 61. It is to be noted that, although the temperature detectors 65 through 68 are contact type thermistors in the present embodiment, temperature detectors 65 through 68 may be contactless detectors such as thermopiles.

The controller 270 controls the first heat lamp 63 and the second heat lamp 64 independently according to the surface temperature of the fixing roller 61 detected by the temperature detectors 65 through 68.

Additionally, as shown in FIG. 4, at least one crown portion or convexity 61*a* projecting outward in the direction of diameter and at least one recessed inverted-crown portion (concavity) 61*b* are formed on the external circumferential surface of the fixing roller 61. Similarly, as shown in FIG. 4, at least one crown portion 62*a* curving outward in the direction of diameter and at least one inverted-crown portion (concavity) 62*b* are formed on an external circumferential surface of the pressing roller 62.

It is to be noted that the crown portions 61*a* and 62*a* are respectively shaped so that diameters of the fixing roller 61 and pressing roller 62 decrease toward both ends from a center portion of the crown portions 61*a* and 62*a* in the axial direction, and the inverted-crown portions 61*b* and 62*b* are respectively shaped so that the diameters of the fixing roller 61 and pressing roller 62 increase toward both ends from a center portion of the inverted-crown portions 61*b* and 62*b* in the axial direction.

In FIG. 4, reference character 71 represent a bearing, 72 represents a step provided outside the fixing roller 61 in the axial direction, 73 represents a disengagement stopping ring fitted around a shaft of the fixing roller 61, 74 represents a step provided outside the pressing roller 62 in the axial direction, and 75 represents a disengagement stopping ring fitted around a shaft of the pressing roller 62. In FIG. 4, heat generating portions 63*a* and 64*a* (first heating portion and second heating portion) including filaments are represented by filled-in squares for the sake of easy understanding.

Figure 5A:
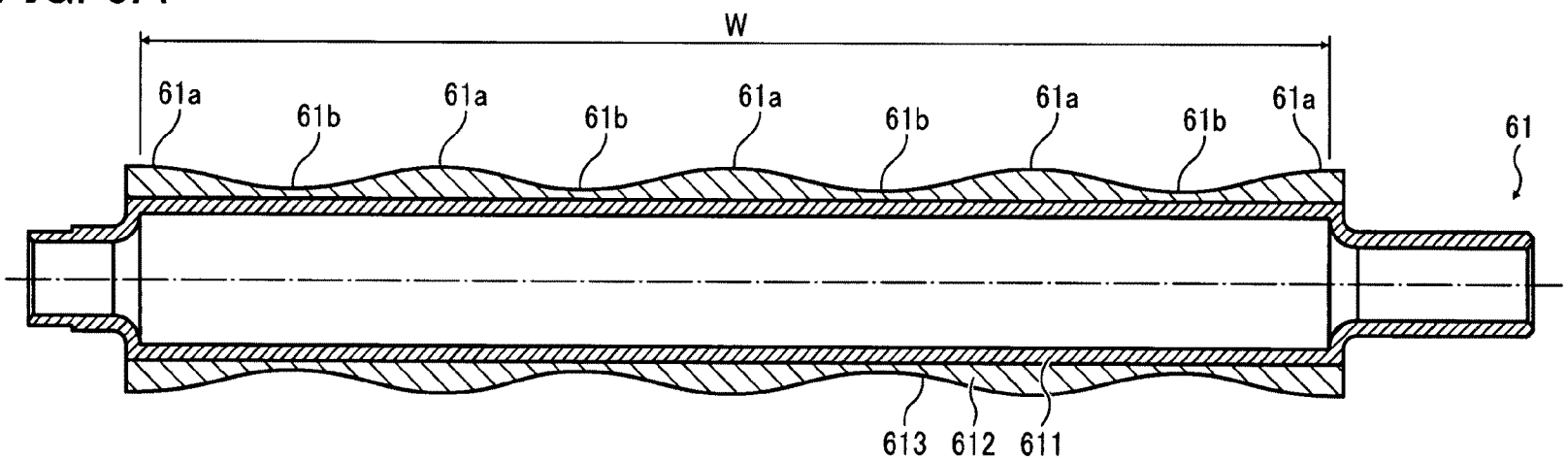
FIGS. 5A and 5B are respectively cross-sectional views illustrating a fixing roller and a pressing roller included in the fixing device shown in FIG. 4.
Figure 5B:
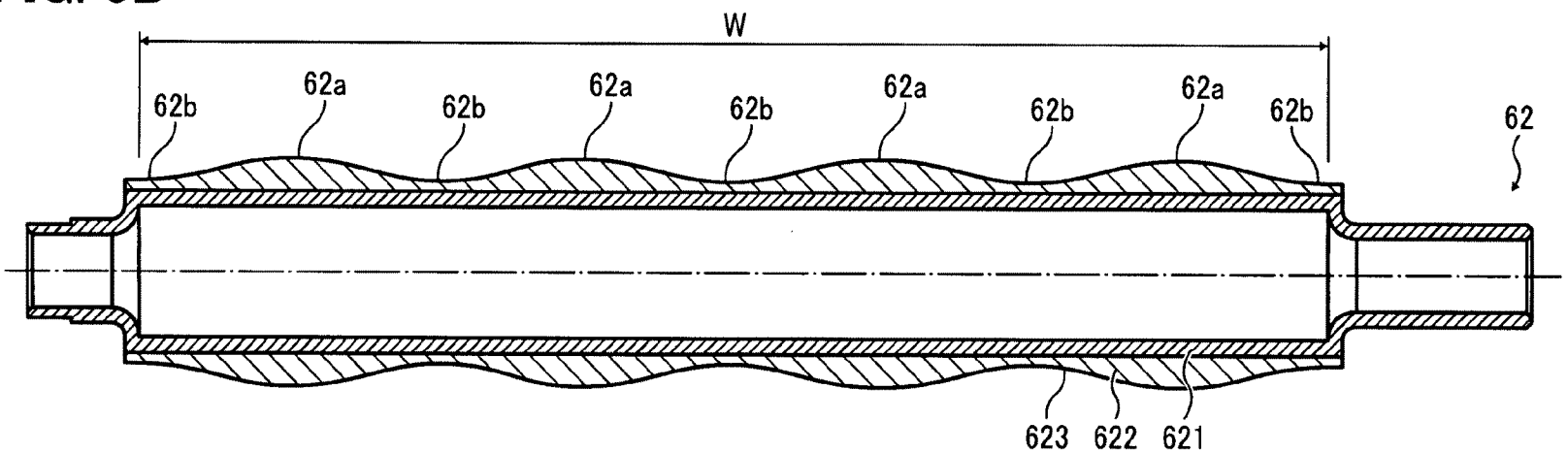

FIG. 5A is a cross-sectional diagram in the axial direction of the fixing roller 61, and FIG. 5B is a cross-sectional diagram in the axial direction of the pressing roller 62. In FIGS. 5A and 5B, reference characters identical to those shown in FIGS. 3 and 4 designate identical or corresponding parts.

In the configuration shown in FIG. 5A, the multiple crown portions 61*a* and the multiple inverted-crown portions 61*b* are arranged alternately in the axial direction of the fixing roller 61, and thus the external surface of the fixing roller 61 is wavy in the axial direction. Similarly, in the configuration shown in FIG. 5B, the multiple crown portions 62*a* and the multiple inverted-crown portions 62*b* are arranged alternately in the axial direction of the pressing roller 62, and thus the external surface of the pressing roller 62 is wavy in the axial direction.

Additionally, in the fixing roller 61, while the thicknesses of the metal core 611 and the release layer 613 are uniform in the axial direction, the elastic layer 612 is configured so that its thickness varies in the axial direction as shown in FIG. 5A. Similarly, in the pressing roller 62, while the thicknesses of the metal core 621 and the release layer 623 are uniform in the axial direction, the elastic layer 622 is configured so that its thickness varies in the axial direction as shown in FIG. 5B. The thickness, that is, the length in the direction of diemter of the fixing roller 61 and the pressing roller 62, of the crown portions 61*a* and 62*a* are greater than that of the reverse-crown portions 61*b* and 62*b*.

Thus, in the fixing roller 61 and the pressing roller 62, the multiple crown portions 61*a* and 62*b* and the multiple inverted-crown portions 61*b* and 62*b* are respectively formed by varying the thicknesses of the elastic layers 612 and 622 in the axial direction. Alternatively, in the fixing roller 61, the thickness of the metal core 611 or the thicknesses of both the metal core 611 and the elastic layer 612 may be varied to create at least one crown portion 61*a* and at least one inverted-crown portion 61*b* in the axial direction differently from the configuration shown in FIG. 5A.

Similarly, in the pressing roller 62, the thickness of the metal core 621 or the thicknesses of both the metal core 621 and the elastic layer 622 may be varied to create at least one crown portion 62*a* and at least one inverted-crown portion 62*b* in the axial direction differently from the configuration shown in FIG. 5B.

Further, as shown in FIGS. 5A and 5B, the crown portions 61*a* and 62*a* and the inverted-crown portions 61*b* and 62*b* are provided entirely across a maximum sheet width W of recording media (sheets) in the axial direction respectively in the fixing roller 61 and the pressing roller 62. It is to be noted that it is not necessary to provide the crown portions 61*a* and 62*a* and the inverted-crown portions 61*b* and 62*b* entirely across the maximum sheet width W in the axial direction respectively in the fixing roller 61 and the pressing roller 62, and the crown portions 61*a* and 62*a* and the inverted-crown portions 61*b* and 62*b* may be provided partly in the maximum sheet width W, that is, partly in an area in which the sheets pass in the axial direction (sheet area).

When the fixing roller 61 and the pressing roller 62 press against each other as shown in FIG. 4, the crown portions 61*a* of the fixing roller 61 match the respective inverted-crown portions 62*b* of the pressing roller 62 while the inverted-crown portions 61*b* of the fixing roller 61 match the crown portions 62*a* of the pressing roller 62. Thus, when the fixing roller 61 and the pressing roller 62 press against each other, all crown portions 61*a* and 62*a* match the respective inverted-crown portions 61*b* and 62*b*.

It is to be noted that, in the fixing roller 61 and the pressing roller 62, although the numbers of the crown portions 61*a* and 62*a* and the inverted-crown portions 61*b* and 62*b* are greater than one and are not specifically limited, the numbers of the crown portions 61*a* and 62*a* and the inverted-crown portions 61*b* and 62*b* are identical so that all crown portions 61*a* and 62*a* can match the respective inverted-crown portions 61*b* and 62*b*.

In this configuration, the crown portions 61*a* and 62*a* and the inverted-crown portions 61*b* and 62*b* of the fixing roller 61 and the pressing roller 62 are respectively shaped into sine curve in the axial direction. It is to be noted that, alternatively, the crown portions 61*a* and 62*a* and the inverted-crown portions 61*b* and 62*b* may form curves other than sine curve. The crown portions 61*a* and 62*a* are configured to fit the shapes of the corresponding inverted-crown portions 61*b* and 62*b*. In other words, when the fixing roller 61 and the pressing roller 62 are in contact with each other with no pressure generated therebetween (hereinafter "contact state without pressure"), no gaps are created between the crown portions 61*a* and 62*a* and the corresponding inverted-crown portions 61*b* and 62*b*.

With the crown portions 61*a* and 62*a* and the inverted-crown portions 61*b* and 62*b*, the fixing nip N is curved or wavy, and accordingly the sheet sandwiched in the fixing nip N is curved along the curved fixing nip when the image is fixed thereon. Because curving the sheet can increase the apparent stiffness of the sheet, winding of the sheet around the fixing roller 61 can be prevented when the sheet is discharged from the fixing device 27.

Additionally, because the fixing roller 61 and the pressing roller 62 press against each other with the crown portions 61*a* and 62*a* matched the respective inverted-crown portions 61*b* and 62*b*, differences in the contact pressure in the fixing nip can be eliminated or reduced. Thus, unevenness in the gross of the fixed image can be reduced, enhancing the image quality.

Figure 6:
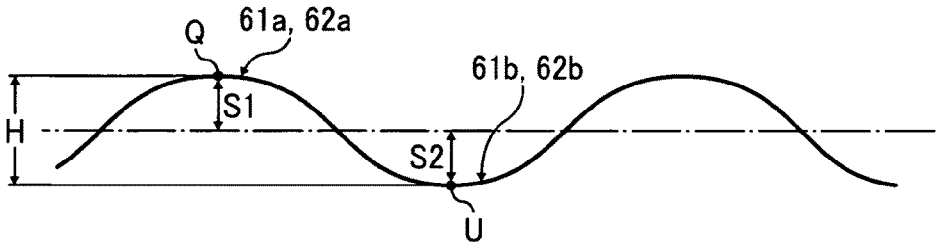
FIG. 6 is a schematic diagram illustrating amplitudes of a crown portion and a inverted-crown portion and differences in height therebetween.

FIG. 6 is an enlarged view of the crown portions 61*a* (or 62*a*) and the inverted-crown portions 61*b* (or 62*b*) of the fixing roller 61 (or the pressing roller 62). In FIG. 6, reference characters S1 represents an amplitude or height of an apex Q of the crown portion 61*a* (or 62*a*), and S2 represents an amplitude or height of a bottom U of the inverted-crown portions 61*b* (or 62*b*). A reference character H represents the difference in height (e.g., a length in the direction of diameter) between the apex Q of the crown portion 61*a* (or 62*a*) and the bottom U of the inverted-crown portion 61*b* (or 62*b*).

The difference in height H is described in further detail below.

In the present embodiment, it is preferable that the difference in height H be within a range from 0.16 mm to 0.8 mm when the fixing roller 61 is in contact with the pressing roller 62 with a certain degree of pressure (hereinafter "contact state with pressure"). If the difference in height H is less than 0.16 mm in the contact state with pressure, the amount by which the sheet P is curved is smaller and accordingly its apparent stiffness is not sufficient for the reliable separation of the sheet P. By contrast, if the difference in height H exceeds 0.8 mm in the contact state with pressure, differences in rotational velocity between the crown portion (convexity) and the inverted-crown portion (recesses) might increase to an extent that the sheet P wrinkles. Therefore, in the present embodiment, it is preferable that the difference in height H be within a range from 0.16 mm to 0.8 mm in the contact state with pressure.

It is to be noted that, compared with the contact state without pressure between the fixing roller 61 and the pressing roller 62, the difference in height H is smaller in the contact state with pressure because the elastic layers 612 and 622 in the fixing roller 61 and the pressing roller 62 are compressed in that state.

Generally, in the fixing roller 61 and the pressing roller 62, because plastic deformation occurs in the elastic layers 612 and 622 when its compression ratio exceeds 20 percent, resulting in disturbance in image and/or an increase in noise, the compression ratio should be not greater than 20 percent. Therefore, in the present embodiment, the compression ratio of the elastic layers 612 and 622 of the fixing roller 61 and the pressing roller 62 are set to 20 percent, for example, and accordingly the difference in height H in the contact state with pressure is 80 percent of that in the contact state without pressure.

By contrast, the difference in height H in the contact state without pressure is greater. More specifically, in the present embodiment with the compression ratio of the elastic layers 612 and 622 set to 20 percent, the difference in height H in the contact state without pressure is multiplication of that in the contact state with pressure (0.16 mm to 0.8 mm) with 1.25, that is, within a range from 0.2 mm to 1 mm. Additionally, because the amplitude (height) S1 of the crown portions 61*a* and 62*a* is identical or similar to the amplitude (height) S2 of the inverted-crown portions 61*b* and 62*b*, the amplitudes S1 and S2 in the contact state without pressure is not greater than haft the difference in height H in the contact state without pressure (0.2 mm to 1 mm). Consequently, the amplitudes S1 and S2 in the contact state without pressure are within a range from 0.1 mm to 0.5 mm.

Additionally, as shown in FIG. 4, the fixing roller 61 and the pressing roller 62 are rotatably provided via the respective bearings 71 such as ball bearings between two side plates, not shown, of the image forming apparatus 1 (shown in FIG. 2), disposed at a predetermined or given interval. The respective bearings 71 are fixed to the side plates of the image forming apparatus 1.

The bearing 71 provided in an end portion of the fixing roller 61 on the left in FIG. 4 is sandwiched between the step 72 and the disengagement stopping ring 73 both provided outside the fixing roller 61 in the axial direction. Similarly, the bearing 71 provided in an end portion of the pressing roller 62 on the left in FIG. 4 is sandwiched between the step 74 and the disengagement stopping ring 75 both provided outside the pressing roller 62 in the axial direction. Thus, the left end portions of the fixing roller 61 and the pressing roller 62 in FIG. 4 are fixed in the axial direction (first axial end portions). By contrast, the bearing 71 provided in the opposite end portion of the fixing roller 61, on the right in FIG. 4, is movable in the axial direction relative to the fixing roller 61. Similarly, the bearing 71 provided in the opposite end portion of the pressing roller 62, on the right in FIG. 4, is movable in the axial direction relative to the pressing roller 62. Accordingly, the right end portions (second axial end portions) of the fixing roller 61 and the pressing roller 62 in FIG. 4 are movable in the axial direction.

As described above, the first axial end portions of the fixing roller 61 and the pressing roller 62 on the same side in the axial direction are fixed, and the other end portions are movable in the axial direction. It is to be noted that the side fixed and the side movable in the axial direction are not specifically limited as long as those are identical in the fixing roller 61 and the pressing roller 62.

Figure 7:
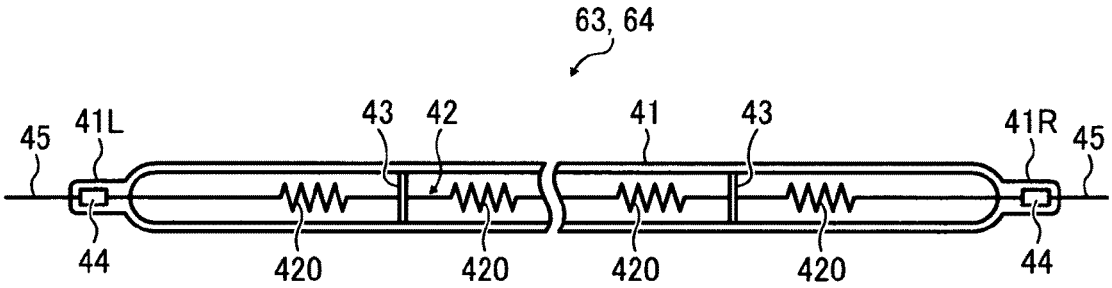
FIG. 7 schematically illustrates a heat lamp.

FIG. 7 is a schematic diagram illustrating a configuration of the first heat lamp 63 and the second heat lamp 64. Referring to FIG. 7, each of the first and second heat lamps 63 and 64 includes an illuminant tube 41 formed with a light-transmissive material such as quartz. The illuminant tube 41 is filled with an inert gas, and a heat generating member 42 formed by individual tungsten wires is provided in the illuminant tube 41. The heat generating member 42 includes multiple filaments 420, that is, the heat generating portions 63*a* or 64*a*, formed by the individual tungsten wires coiled partially. The heat generating member 42 is supported by multiple supporters 43 to prevent contact between the heat generating member 42 and an inner surface of the illuminant tube 41. Sealing portions 41L and 41R disposed in both end portions of the illuminant tube 41 include a metal foil 44 formed of molybdenum, for example. One end of each metal foil 44 is connected to the heat generating member 42, and the other end of the metal foil 44 is connected to an electrode bar 45 formed of molybdenum, tungsten, or the like. Each electrode bar 45 is electrically connected to an external lead, not shown, and voltage is applied between the two electrodes 45 to energize the heat generating member 42, thereby inducing the filaments 420 to generate heat.

Referring to FIG. 4, the heat generating portions 63*a* and 64*a* of the first and second heat lamps 63 and 64 provided in the fixing roller 61 are disposed at positions different from each other. More specifically, the heat generating portions 63*a* of the first heat lamp 63 are disposed corresponding to the respective crown portions 61*a* of the fixing roller 61 while the heat generating portions 64*a* of the second heat lamp 64 are disposed at positions corresponding to the respective inverted-crown portions 61*b* of the fixing roller 61.

Figure 8:
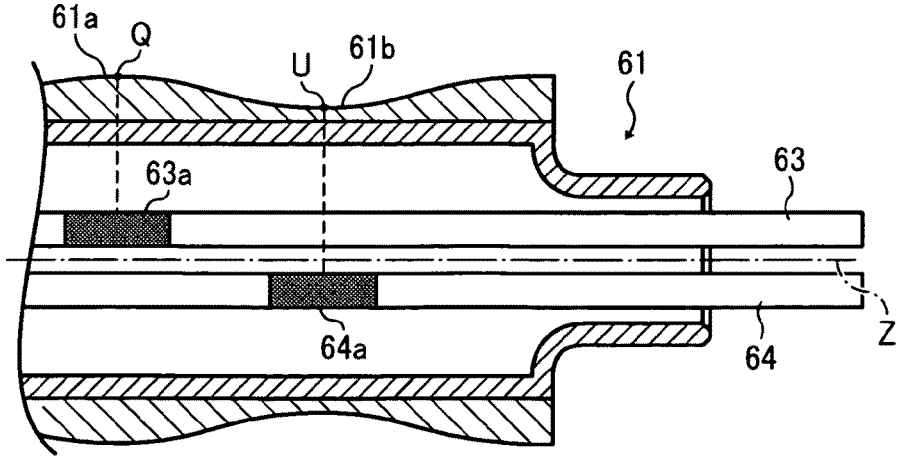
FIG. 8 is an enlarged view illustrating a main portion of the fixing roller shown in FIG. 4.

Further, as shown in FIG. 8, it is preferable that the heat generating portions 63*a* of the first heat lamp 63 be positioned to match the apexes Q of the respective crown portions 61*a* in the axial direction, and the heat generating portions 64*a* of the second heat lamp 64 be positioned to match the bottoms U of the respective inverted-crown portions 61*b*. With this configuration, fluctuations in the surface temperature of the fixing roller 61 can be reduced effectively.

Because heat transmission from inside the fixing roller 61 to the external surface is less easy in the crown portions 61*a* than in the inverted-crown portions 61*b*, difference in temperature is greater between the apexes Q of the crown portions 61*a* and the bottoms U of the inverted-crown portions 61*b*. Therefore, in the present embodiment, the heat generating portions 63*a* and 64*a* of the first and second heat lamps 63 and 64 are disposed corresponding to the apexes Q and the bottoms U, and the amount of heat generated (heat generation amount) by the heat generating portions 63*a* of the first heat lamp 63 is greater than that of the heat generating portions 64*a* of the second heat lamp 64. To increase the heat generation amount) by the heat generating portions 63*a* from that of the heat generating portions 64*a*, the diameter of the coiled filament of the first heat lamp 63 is greater than that of the second heat lamp 64, or alternatively, the number of turn (pitch) per unit length of the filament of the first heat lamp 63 is greater than that of the second heat lamp 64.

When the heat generation amount by the first heat lamp 63 (first heat generating member) is greater than that by the second heat lamp 64 (second heat generating member), the crown portions 61*a* can be heated efficiently. Therefore, differences in the surface temperature of the fixing roller 61 can be reduced, making the surface temperature of the fixing roller 61 more uniform in the axial direction.

Moreover, referring to FIG. 4, the temperature detectors 65 and 66 are disposed in an end portion close to an end in the axial direction of the fixing roller 61 while the temperature detectors 67 and 68 are disposed in a center portion closer to a center in the axial direction of the fixing roller 61.

Herein, the center portion of the fixing roller 61 in the axial direction is less easily heated because the sheet passing therein draws heat from the fixing roller 61. By contrast, the end portion of the fixing roller 61 in the axial direction can be heated easily because the sheet passes therein less frequently. Therefore, by disposing the two temperature detectors (65 and 66, and 67 and 68) respectively to match the crown portions 61*a* and the inverted-crown portions 61*b* in the end portion as well as the center portion in the axial direction, the temperature of the fixing roller 61 in the axial direction can be equalized more effectively.

Additionally, the temperature detector 66 disposed in the end portion serves as a first projecting-portion temperature detector and is positioned to match the apex Q (shown in FIG. 8) of the crown portion 61*a*. The temperature detector 65 also disposed in the end portion serves as a first concavity temperature detector and is positioned to match the bottom U (shown in FIG. 8) of the inverted-crown portion 61*b*. Similarly, the temperature detector 67 disposed in the center portion serves as a second projecting-portion temperature detector and is positioned to match the apex Q (shown in FIG. 8) of the crown portion 61*a*. The temperature detector 68 disposed also in the center portion servers as a second concavity temperature detector and is positioned to match the bottom U (shown in FIG. 8) of the inverted-crown portion 61*b*.

Disposing the temperature detectors 66 and 67 in the crown portion 61*a* and disposing the temperature detectors 65 and 68 in the inverted-crown portion 61*b* can detect differences in the surface temperature of the fixing roller 61 because heat transmission efficiency is different between the crown portions 61*a* and the inverted-crown portions 61*b* as described above.

Further, because the difference in temperature is maximum between the apexes Q of the crown portions 61*a* and the bottoms U of the inverted-crown portions 61*b*, the difference in temperature in the axial direction can be better detected by disposing the multiple temperature detectors 65 through 68 to match the apexes Q and the bottoms U.

It is preferable that a pair of temperature detectors (65 and 66) disposed in the end portion in the axial direction be disposed to match the crown portion 61 and the inverted-crown portion 61*b* adjacent to each other. Similarly, it is preferable that a pair of temperature detectors (67 and 68) disposed in the center portion in the axial direction be disposed to match the crown portion 61 and the inverted-crown portion 61*b* adjacent to each other. By disposing the two temperature detectors 65 and 66 or 67 and 68 to detect the crown portion 61*a* and the inverted-crown portion 61*b* adjacent to each other, the temperature around them can be detected more precisely.

Further, the temperature detectors 65 and 66 are provided in the end portion on the fixed side of the fixing roller 61. With this configuration, even when the fixing roller 61 expands or shrinks in the axial direction due to heat or the like, displacement of the positions at which the temperature is detected by the temperature detectors 65 through 68 can be reduced. Thus, temperature detection can be more accurate.

As described above, because two temperature detectors 65 and 66 are disposed in the end portion, which is more easily heated, while two temperature detectors 67 and 68 are disposed in the center portion, which is heated less easily because of the heat drown by the sheet, in the axial direction, differences in temperature of the fixing roller 61 in the axial direction can be detected reliably. Then, by controlling the first and second heat lamps 63 and 64 based on the temperature detected by the temperature detectors 65 through 68, differences in temperature of the fixing roller 61 in the axial direction can be reduced effectively.

Further, by independently controlling the heat generating portion 63*a* of the first heat lamp 63 corresponding to the crown portion 61*a* and the heat generating portion 64*a* of the second heat lamp 64 corresponding to the inverted-crown portion 61*b*, differences in the surface temperature of the fixing roller 61 can be reduced further effectively. Consequently, the temperature of the fixing roller 61 in the axial direction can be equalized more effectively.

Operation of the fixing device 27 shown in FIG. 3 is described below.

In the fixing process performed by the fixing device 27 shown in FIG. 3, initially, the first and second heat lamps 63 and 64 are activated to heat the fixing roller 61. The controller 270 controls the first and second heat lamps 63 and 64 so that the surface temperature of the fixing roller 61 is raised to a predetermined temperature based on the temperature detected by the temperature detectors 65 through 68. Then, the sheet P carrying an unfixed toner image T is transported in a direction indicated by arrow A shown in FIG. 3 (hereinafter "sheet transport direction A") to the fixing nip N formed between the fixing roller 61 and the pressing roller 62 rotating in directions indicated by arrows B and C, respectively. The toner image T on the sheet P is fused with the heat from the fixing roller 61 and then is fixed with the pressure generated between the fixing roller 61 and the pressing roller 62 while the sheet P passes through the fixing nip N.

In the present embodiment, the fixing nip N is wavy as shown in FIG. 4 because the fixing roller 61 and the pressing roller 62 are pressed against each other with the crown portions 61*a* and 62*a* fitted in the inverted-crown portion 61*b* and 62*b*. When the sheet P is sandwiched in the wavy fixing nip N, the sheet P is curved accordingly in the axial direction or longitudinal direction of the fixing device.

As described above, with the configuration described above, the apparent stiffness of the sheet P can be increased by curving the fixing nip N in the axial direction or longitudinal direction, and accordingly separation of the sheet P from the fixing roller 61 can be enhanced. By inhibiting widing of the sheet, jamming of sheets can be reduced or prevented.

Second Embodiment

Next, a fixing device 27A according to a second embodiment of the present invention is described below.

Figure 9:
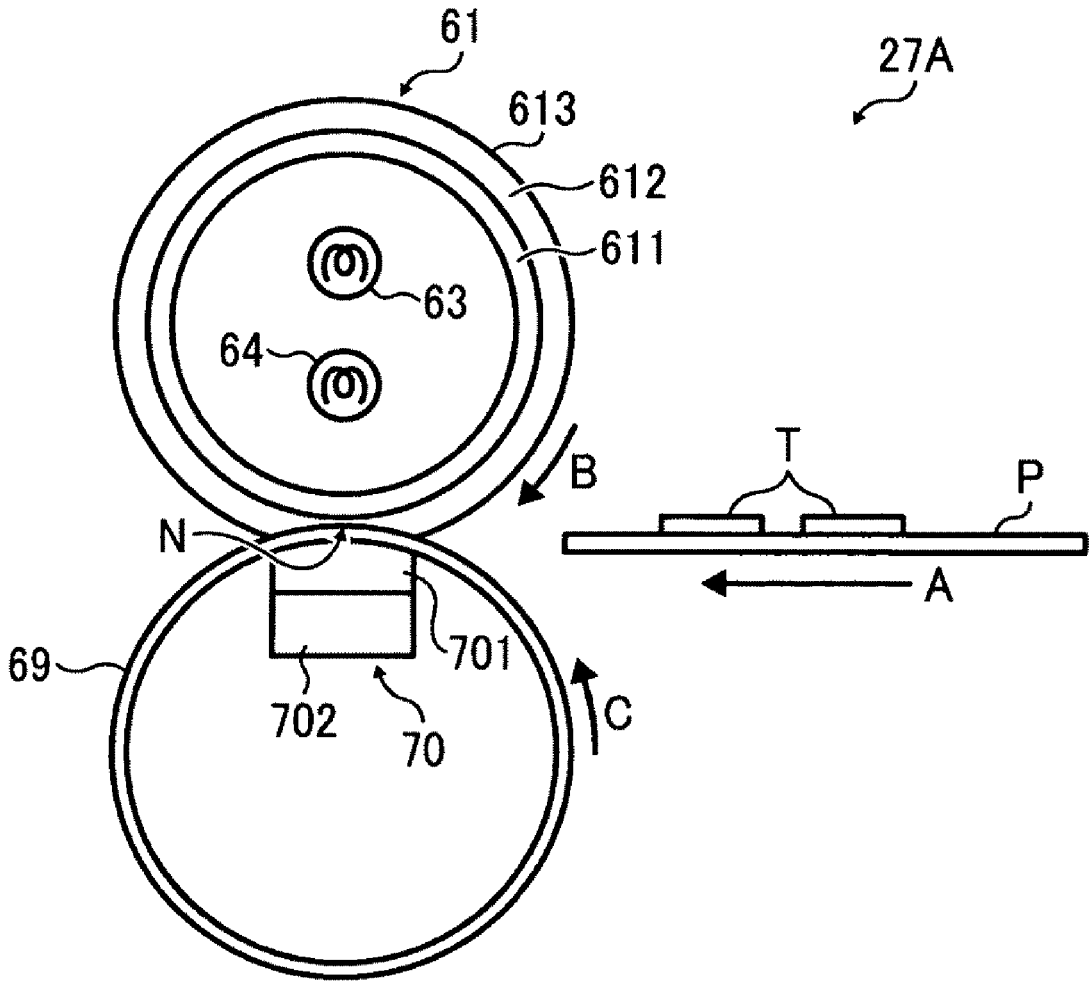
FIG. 9 is an end-on cross-sectional view illustrating a fixing device according to a second embodiment.
Figure 10:
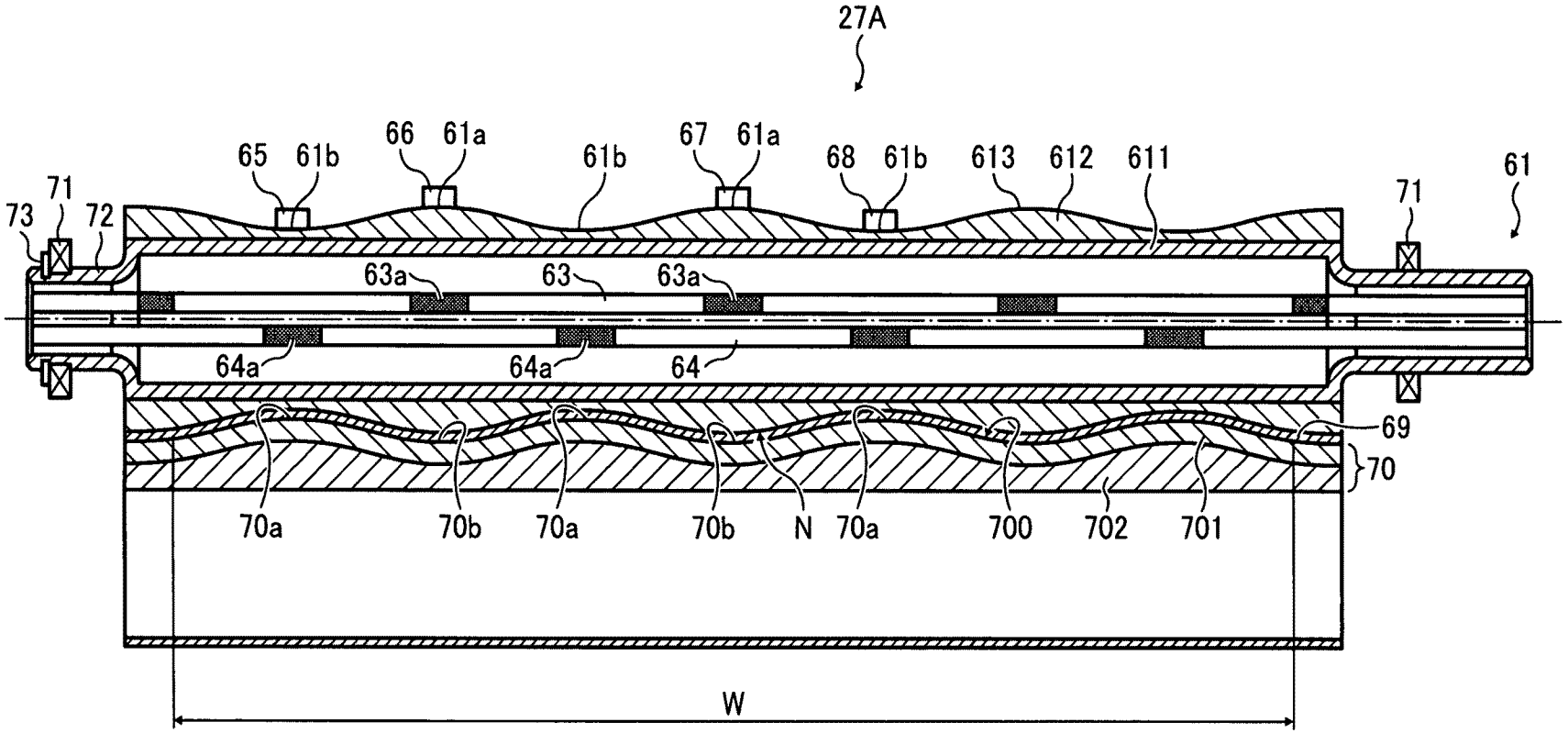
FIG. 10 is a front cross-sectional view illustrating the fixing device shown in FIG. 9.

As shown in FIGS. 9 and 10, the fixing device 27A includes a fixing roller 61, a pressing belt 69 instead of the pressing roller 62 shown in FIG. 3, and a pressure member 70 configured to push an inner surface of the pressing belt 69, thereby pressing the pressing belt 69 against the fixing roller 61. The pressing belt 69 and the pressure member 70 together form a pressing unit. A fixing nip N is formed between the fixing roller 61 and the pressing belt 69 pressing against each other.

The fixing device 27A according to the second embodiment further includes a first heat lamp 63, a second heat lamp 64, and temperature detectors 65 through 68 similarly to the fixing device 27 shown in FIG. 3. The components given reference characters identical to those in the first embodiment have similar configurations, and thus descriptions thereof are omitted.

The sheet P carrying a toner image T passes through the fixing nip N formed between the fixing roller 61 and the pressing belt 69 in the sheet transport direction indicated by arrow A shown in FIG. 9 (sheet transport direction A).

The pressing belt 69 is an endless belt formed of polyimide or the like. The pressing belt 69 winding around a support member is not tensed and configured to rotate as the fixing roller 61 rotates. The pressure member 70 includes an elastic layer 701 formed by silicone rubber or the like and a holder 702 holding the elastic layer 701. The holder 702 is biased toward the fixing roller 61 by a bias member, not shown, such as a spring.

As shown in FIG. 10, the pressure member 70 includes a pressure surface 700 serves as a facing surface facing the fixing roller and is configured to press the fixing belt 69. At least one convexity 70*a* curving toward the fixing roller 61 and at least one recess (concavity) 70*b* curved away from the fixing roller 61 are formed on the pressure surface 700. In the configuration shown in FIG. 10, multiple convexities 70*a* and multiple recesses 70*b* are arranged alternately in a longitudinal direction of the fixing device 27A or the axial direction of the fixing roller 61, and thus the pressure surface 700 is wavy in the longitudinal direction.

The multiple convexities 70*a* and the multiple recesses 70*b* are formed on the pressure surface 700 of the pressure member 70 by varying the thicknesses of the holder 702 in the longitudinal direction. Alternatively, the thickness of the elastic layer 701 or the thicknesses of both the elastic layer 701 and the holder 702 may be varied in the longitudinal direction to create at least one convexity 70*a* and at least one recess 70*b*, differently from the configuration shown in FIG. 10. Additionally, although the multiple convexities 70*a* and the multiple recesses 70*b* are provided entirely across the maximum sheet width W of the recording medium (sheet P) in the longitudinal direction in the configuration shown in FIG. 10, the convexities 70*a* and the recesses 70*b* may be provided partly in the maximum sheet width W, that is, partly in the sheet area in which the sheets pass in the longitudinal direction.

As shown in FIG. 10, when the pressing belt 69 is pressed against the fixing roller 61 by the pressure member 70, the crown portions 61*a* of the fixing roller 61 match the respective recesses 70*b* of the pressure member 70 while the inverted-crown portions 61*b* of the fixing roller 61 match the respective convexities 70*a* of the pressure member 70. The convexities 70*a* and the recesses 70*b* of the pressure member 70 are configured to fit the shapes of the corresponding inverted-crown portions 61*b* and the crown portions 61*a* of the fixing roller 61, respectively. When the pressing belt 69 is sandwiched between the fixing roller 61 and the pressure member 70 configured as described above, the pressing belt 69 becomes wavy in the sandwiched portion. However, other then the sandwiched portion, the pressing belt 69 is substantially flat.

It is to be noted that, although the numbers of the crown portions 61*a* and the inverted-crown portions 61*b* of the fixing roller 61 and the convexities 70*a* and the recesses 70*b* of the pressure member 70 are greater than one and are not specifically limited, the numbers of them are set so that all crown portions 61*a* and the inverted-crown portions 61*b* can fit the recesses 70*b* and the convexities 70*a*, respectively.

Additionally, in the present embodiment, the crown portions 61*a* and the inverted-crown portions 61*b* of the fixing roller 61 and the convexities 70*a* and the recesses 70*b* of the pressure member 70 can be shaped into sine curve or a given shape that is partly linear.

Similarly to the difference in height H between the apex Q of the crown portions 61*a* and 62*a* and the bottom U of the inverted-crown portions 61*b* and 62*b* shown in FIG. 6, it is preferable that, when the pressure member 70 does not press against the fixing roller 61 (contact state without pressure), the difference in height between an apex of the convexity 70*a* and a bottom of the recess 70*b* be within a range from 0.2 mm to 1 mm. Additionally, it is preferable that, when the convexities 70*a* and the recesses 70*b* are shaped into sine curve, the convexities 70*a* and the recesses 70*b* have amplitudes within a range from 0.1 mm to 0.5 mm.

Also in this case, similarly to the embodiment shown in FIGS. 3 through 8, the compression ratio of the elastic layers 612 and 701 of the fixing roller 61 and the pressure member 70 are set to 20 percent, for example, and accordingly, in the contact state with pressure, the difference in height between the apex of the convexity 70*a* and the bottom of the recess 70 is 80 percent of that in the contact state without pressure.

More specifically, in the contact state with pressure, the difference in height is preferably within a range from 0.16 mm to 0.8 mm.

When an unfixed toner image T formed on the sheet P is fixed in the fixing device 27A shown in FIG. 9, similarly, the fixing roller 61 is heated to a predetermined temperature. Then, the sheet P is transported in the sheet transport direction A to the fixing nip N formed between the fixing roller 61 and the pressing belt 69 rotating in directions indicated by arrows B and C, respectively. The toner image T on the sheet P is fixed with heat and pressure in the fixing nip N.

Also in the second embodiment shown in FIGS. 9 and 10, the crown portions 61*a* of the fixing roller 61 and the respective recesses 70*b* of the pressure member 70 are provided to match each other while the inverted-crown portions 61*b* of the fixing roller 61 and the respective convexities 70*a* of the pressure member 70 are provided to match each other. Thus, the fixing nip N is curved in the longitudinal direction as shown in FIG. 10 because the fixing roller 61 and the pressing belt 69 are pressed against each other in this state. Therefore, the sheet P can be curved when sandwiched in the fixing nip N, which can increase the apparent stiffness of the sheet P when the sheet P is discharged from the fixing nip N. Consequently, when the sheet P is discharged from the fixing nip N, winding of the sheet P around the fixing roller 61 can be prevented or reduced.

Third Embodiment

Next, a fixing device according to a third embodiment of the present invention is described below.

Figure 11:
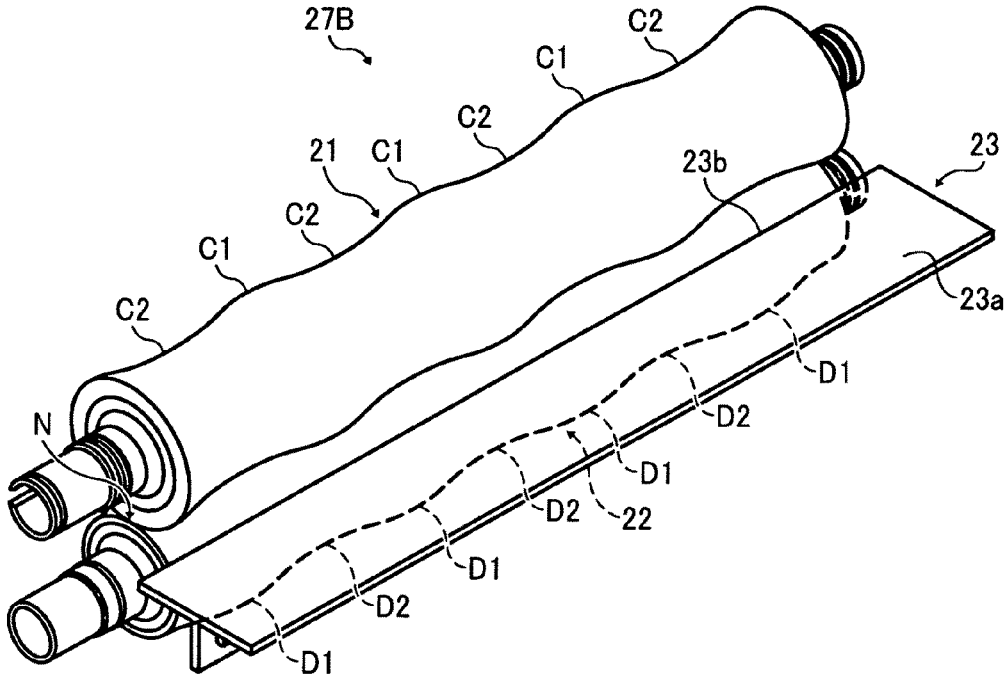
FIG. 11 is a perspective view illustrating a fixing device according to a third embodiment.

FIG. 11 is a perspective view illustrating a fixing device 27B according to the third embodiment.

As shown in FIG. 11, the fixing device 27B includes a fixing roller 21, a pressing roller 22, and a sheet guide member 23. The pressing roller 22 presses against the fixing roller 21 with a predetermined or given pressure, and a fixing nip N is formed between the fixing roller 21 and the pressing roller 22. Each of the fixing roller 21 and the pressing roller 22 has an external circumferential surface that is wavy in its axial direction or longitudinal direction as shown in FIG. 11. More specifically, on the external surface of the fixing roller 21, multiple crown portions C1 projecting outward in the direction of diameter and multiple inverted-crown portions C2 curved inward in the direction of diameter are formed alternately in the axial direction. Similarly, on the external surface of the pressing roller 22, multiple crown portions D1 projecting outward in the direction of diameter and multiple inverted-crown portions D2 recessed from the crown portions D1 in the direction of diameter are formed alternately in the axial direction. As described above, "crown portion" means a portion shaped so that diameter of the roller decreases toward both ends from a center portion of the crown portion in the axial direction, and "inverted-crown portion" means a portion shaped so that the diameter of the roller increases toward both ends from a center portion of the inverted-crown portion in the axial direction.

Figure 12:
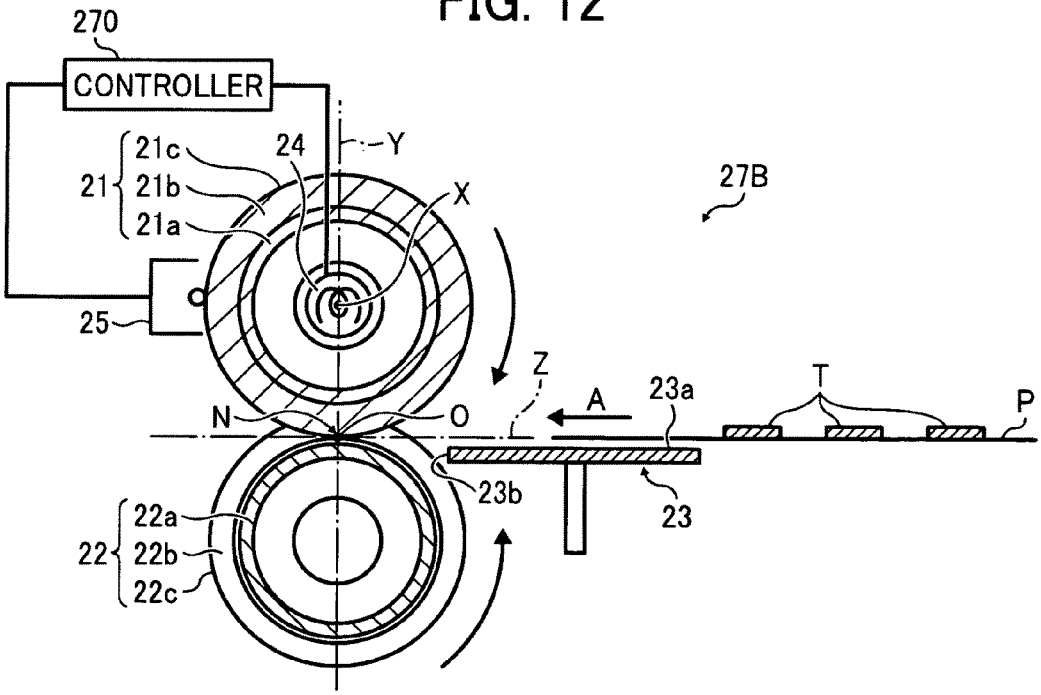
FIG. 12 is an end-on cross-sectional view illustrating the fixing device shown in FIG. 11.

FIG. 12 is a cross-sectional view of the fixing device 27B in a direction perpendicular to the axial direction of the fixing roller 21 and the pressing roller 22. In FIGS. 11 and 12, reference characters 23*a* represents a surface of the sheet guide member 23 (e.g., a facing surface) facing the sheet transport path, and 23*b* represents an downstream edge surface of the sheet guide member 23 in the sheet transport direction A.

As shown in FIG. 12, a heater 24 serving as a heat source is provided inside the fixing roller 21, and the heater 24 extends in the axial direction of the fixing roller 21, which is a direction perpendicular to the surface of paper on which FIG. 12 is drawn. The fixing roller 21 is heated with the heat generated by the heater 24. As shown in FIG. 12, a temperature detector 25 is provided adjacent to the external circumferential surface of the fixing roller 21 to detect a surface temperature of the fixing roller 21. A controller 270 is configured to adjust the amount of heat generated by the heater 24 so that the surface temperature of the fixing roller 21 is raised to a predetermined temperature based on the surface temperature of the fixing roller 21 detected by the temperature detectors 25.

Figure 13:
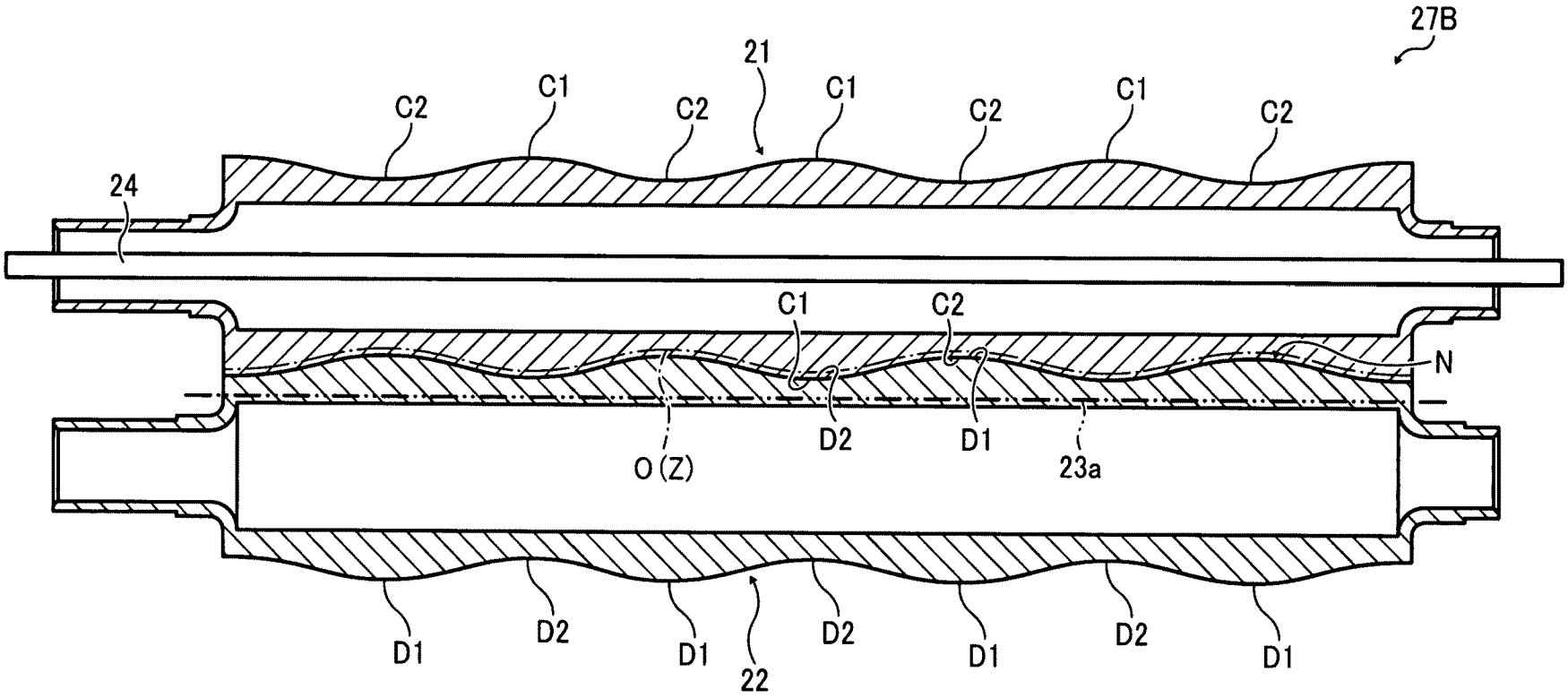
FIG. 13 is a front cross-sectional view illustrating the fixing device shown in FIG. 11.

The fixing roller 21 includes a cylindrical metal core 21*a*, an elastic layer 21*b* lying over the metal core 21*a*, and a release layer 21*c* lying over the elastic layer 21*b*. In the present embodiment, the multiple crown portions C1 and the multiple inverted-crown portions C2 are formed by varying the thicknesses of the elastic layers 21*b* in the axial direction as shown in FIG. 13. Alternatively, the thickness of the metal core 21*a* may be varied in the axial direction to create at least one crown portion C1 and at least one inverted-crown portion C2.

The pressing roller 22 includes a cylindrical metal core 22*a*, an elastic layer 22*b* lying over the metal core 21*a*, and a release layer 22*c* lying over the elastic layer 22*b*. Similarly to the fixing roller 21, the multiple crown portions D1 and the multiple inverted-crown portions D2 are formed by varying the thicknesses of the elastic layers 22*b* in the axial direction as shown in FIG. 13. Alternatively, the thickness of the metal core 22*a* may be varied in the axial direction to create at least one crown portion D1 and at least one inverted-crown portion D2.

The fixing roller 21 rotates clockwise in FIG. 12, driven by a driving unit, not shown. The pressing roller 21 rotates counterclockwise in FIG. 12 as the fixing roller 21 rotates. A sheet P carrying an unfixed toner image T is transported in a sheet transport direction indicated by arrow A shown in FIG. 12 to the fixing nip N formed between the fixing roller 21 and the pressing roller 22 thus rotating. Then, the toner image T on the sheet P is fixed with heat and pressure in the fixing nip N.

The sheet guide member 23 is configured to guide the sheet P to the fixing nip N. Therefore, the sheet guide member 23 is disposed upstream from the fixing nip N in the sheet transport direction A shown in FIG. 12. Additionally, the sheet guide member 23 is disposed facing a lower surface of the sheet P in FIG. 12 (non-image surface), opposite an image surface of the sheet P on which the toner image T is formed, so that the sheet guide member 23 does not contact the unfixed toner image T while guiding the sheet P.

Further, it is preferable that the sheet guide member 23 has an electrical resistivity capable of preventing leakage of a transfer electrical current applied to secondary-transfer nip to transfer the image onto the sheet P in the secondary-transfer nip because the sheet guide member 23 is positioned adjacent to the secondary-transfer nip. When the image T is transferred from the intermediate transfer belt 30 onto the sheet P as described above with reference to FIG. 2, a secondary-transfer bias that is either current or voltage is applied to the secondary-transfer nip, thereby forming a secondary-transfer electrical field, and then the toner image T is transferred onto the sheet P with the effect of the secondary-transfer electrical field. At that time, if a leading edge portion of the sheet P contacts the sheet guide member 23 with its trailing edge portion caught in the secondary-transfer nip, the transfer current forming the secondary-transfer electrical field might leak through the sheet guide member 23 via the sheet P.

In view of the foregoing, in the present embodiment, the sheet guide member 23 has an electrical resistivity capable of preventing leakage of the transfer current. Therefore, even if the sheet P contacts the sheet guide member 23 during image transfer, the transfer current can be prevented from leaking through the sheet guide member 23 via the sheet P, attaining reliable image transfer. For example, such electrical resistivity can be attained by forming the sheet guide member 23 with an electrical-insulative material, or an electrical-insulative member may be provided between the sheet guide member 23 and a grounding member.

FIG. 13 is a cross-sectional view of the fixing roller 21 and the pressing roller 22 in a direction parallel to their axial direction.

As shown in FIG. 13, the fixing roller 21 and the pressing roller 22 press against each other with the crown portions C1 of the fixing roller 21 fitted in the respective inverted-crown portions D2 of the pressing roller 22 and the crown portions D2 of the pressing roller 22 fitted in the inverted-crown portions C2 of the fixing roller 21. Thus, also in the present embodiment, the convexities (crown portions) and the recesses (inverted-crown portions) of the fixing roller 21 and the pressing roller 22 fit each other, making the fixing nip N wavy in the axial direction.

The position of the sheet guide member 23 is described in further detail below.

In FIG. 12, reference characters O represents a centerline of the fixing nip N in the sheet transport direction A, X represents an axial line of the fixing roller 21, Y represents a plane passing through both the centerline O and the axial line X, and Z represents a plane passing through the centerline O, perpendicular to the plane Y. The sheet facing surface 23*a* of the sheet guide member 23 is disposed lower than the plane Z (hereinafter "curve reference plane Z") in FIG. 12, that is, closer to the pressing roller 22 than the curve reference plane Z is. In other words, the sheet guide member 23 is farther from the fixing roller 21 than the curve reference plane Z is. Generally, the fixing nip N has a certain length in the sheet transfer direction A to attain desirable fixing performance. It is to be noted that, when a center position of the fixing nip N in the sheet transport direction A is extended in the axial direction of the fixing roller 21 and the pressing roller 22, the above-described centerline O of the fixing nip Z in the sheet transport direction A is drawn. Additionally, because the fixing nip N is curved or wavy in the present embodiment as shown in FIG. 13, the centerline O is also curved in the axial direction along the fixing nip N. Accordingly, the curve reference plane Z passing through the centerline O is also curved or wavy as shown in FIG. 13. It is to be noted that a dotted line positioned beneath the curve reference plane Z in FIG. 13 indicates the position of the sheet facing surface 23*a* of the sheet guide member 23 facing the sheet transport path.

It is preferable that the height (amplitude) of the crown portion (convexity) and the inverted-crown portion (concavity) be within a range from 0.1 mm to 0.5 mm in each of the fixing roller 21 and the pressure roller 22 (facing surface of the pressing unit) when the fixing roller 21 is in contact with the pressing unit without pressure. In other words, it is preferable that the difference in height between the apex of the crown portion (or convexity) and the bottom of the inverted-crown portion (or recesses) be within a range from 0.2 mm to 1 mm in the contact state without pressure. Those heights are preferably 0.1 mm or higher, that is, the difference in height between them is 0.2 mm or greater because if those heights are less than 0.1 mm, the amount by which the sheet P is curved is smaller and accordingly its apparent stiffness is not sufficient for the reliable separation of the sheet P. Those heights are preferably 0.5 mm or lower, that is, the difference in height between them is 1 mm or smaller because if those heights exceed 0.5 mm (difference in height exceeds 1 mm), differences in rotational velocity between the crown portion (convexity) and the inverted-crown portion (recesses) might increase to an extent that the sheet P wrinkles.

As described above, the fixing nip N is wavy in the longitudinal direction also in this embodiment. Therefore, when the sheet P is sandwiched in the fixing nip N, the sheet P is curved in the axial direction or longitudinal direction along the shape of the fixing nip N. Because curving the sheet P can increase the apparent stiffness of the sheet P, winding of the sheet P around the fixing roller 21 can be prevented when the sheet P is discharged from the fixing device.

Herein, if the sheet P being curved along the wavy fixing nip N contacts the sheet guide member 23, the direction in which the sheet P is transported can be changed and accordingly sheet transportation can be disturbed. If the image surface of the sheet P contacts peripheral components, the unfixed image on sheet P might be disturbed or the sheet P may wrinkle or be damaged. Therefore, in the present embodiment, the sheet guide member 23 is disposed closer to the pressing member (pressing roller 22 or pressure belt 69) than the curve reference surface Z to prevent the contact between the sheet P and the sheet guide member 23 when the sheet P is being caught in the fixing nip N and thus the sheet P is lower than the inverted-crown portion C2 of the fixing roller 21 at the position of the crown portion C1 of the fixing roller 21 in FIG. 13. In other words, the curve reference surface Z is a virtual curved plane representing the transport path of the curved sheet P, and the guide member 23 can be shifted from the sheet transport path by disposing the guide member 23 closer to the pressing roller 22 than the curve reference surface Z is. Thus, disturbance in the image, and wrinkles on and damage to the sheet P can be prevented.

Fourth Embodiment

A fixing device 27C according to a fourth embodiment of the present embodiment is described below with reference to FIGS. 14 through 16.

Figure 14:
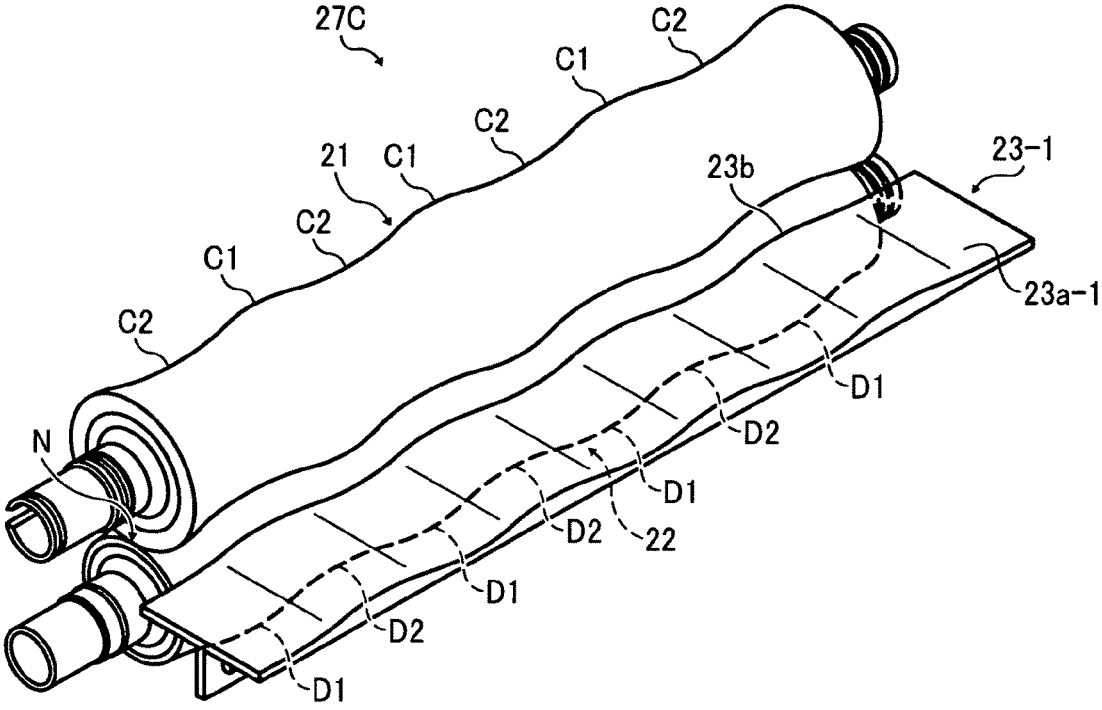
FIG. 14 is a perspective view illustrating a fixing device according to a fourth embodiment.
Figure 15:
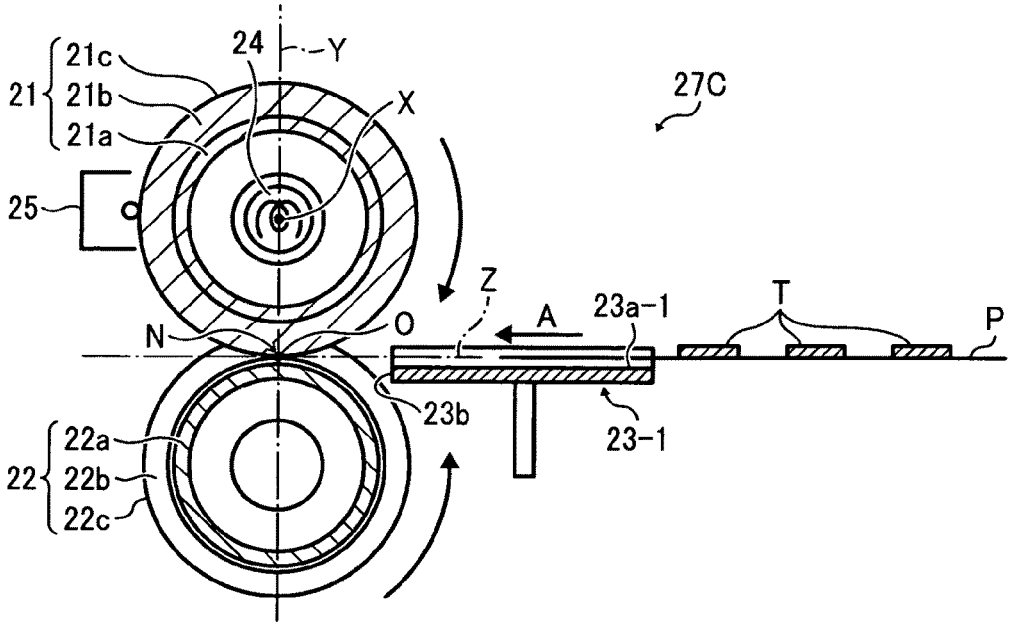
FIG. 15 is an end-on cross-sectional view illustrating the fixing device shown in FIG. 14.
Figure 16:
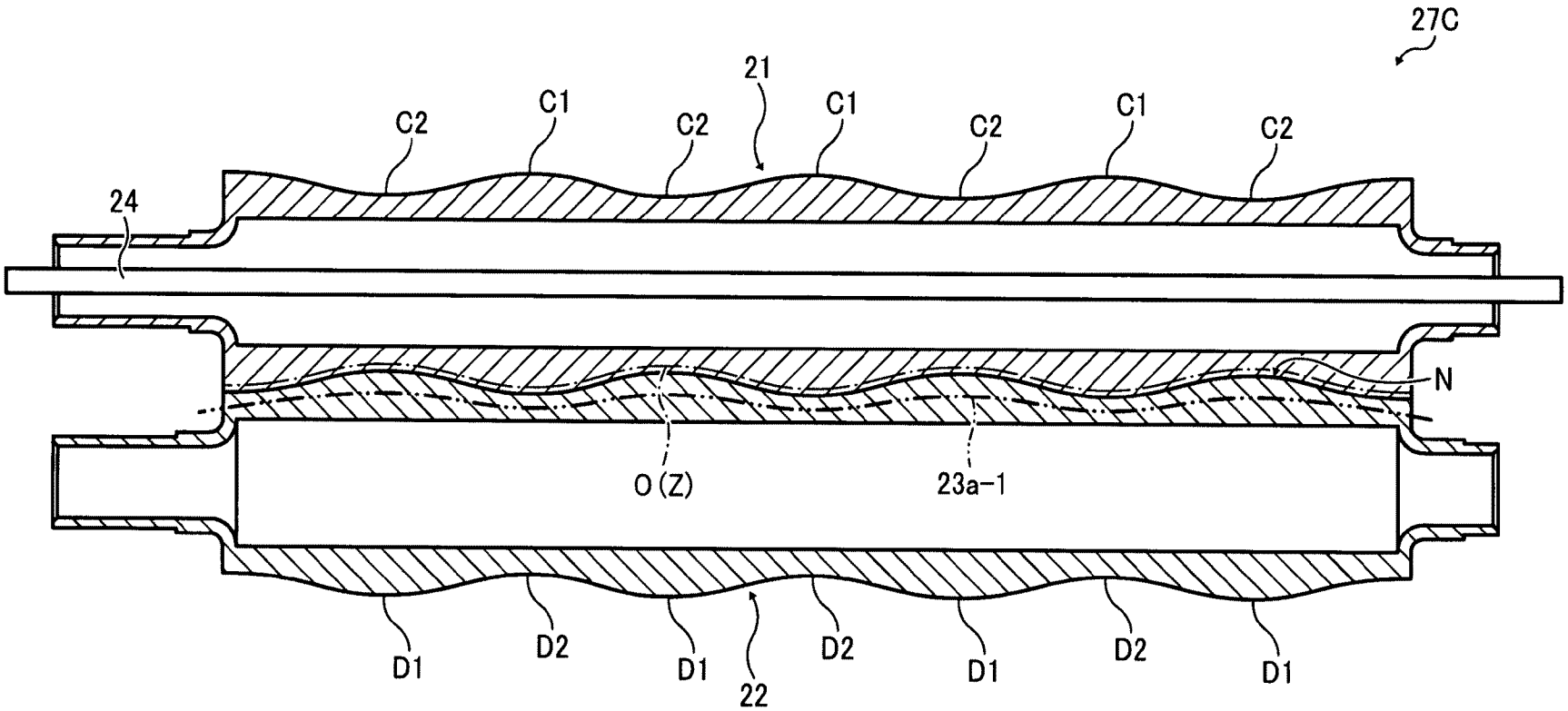
FIG. 16 is a front cross-sectional view illustrating the fixing device shown in FIG. 14.

As shown in FIGS. 14 through 16, in the fourth embodiment, the fixing roller 21 and the pressure roller 22 respectively include the crown portions C1 and D1 and the inverted-crown portions C2 and D2 formed alternately in the axial direction, similarly to the above-described embodiments. Therefore, the fixing nip N formed by pressing the fixing roller and the pressing roller 22 against each other is curved and wavy as shown in FIG. 16. However, a sheet guide member 23-1 in the fourth embodiment has a configuration different from that of the sheet guide member 23 in the third embodiment. As shown in FIG. 14, a sheet guiding surface 23*a*-1 of the sheet guide member 23-1 facing the sheet transport path is curved and wavy. More specifically, as shown in FIG. 16, the sheet facing surface 23*a*-1 of the sheet guide member 23-1 is curved to conform substantially to the shape (concavities and recesses) of the fixing nip N.

Similarly to the configuration shown in FIG. 12, also in the present embodiment, the sheet facing surface 23*a*-1 of the sheet guide member 23-1 is disposed lower than the curve reference plane Z in FIGS. 15 and 16. Therefore, the sheet guide member 23-1 is disposed closer to the pressing roller 22 than the curve reference plane Z is.

Other than the difference described above, the configuration according to the fourth embodiment is similar to that of the above-described third embodiment, attaining similar effects, and thus description thereof is omitted.

Because the fixing nip N is wavy, if the sheet facing surface 23*a*-1 of the sheet guide member 23-1 is flat similarly to the sheet guide member 23 shown in FIGS. 11 and 12, the distance between the fixing nip N and the downstream edge portion 23*b*, that is, the downstream edge of the sheet facing surface 23*a*-1, of the sheet guide member 23-1 in the sheet transport direction is not uniform. In particular, as shown in FIG. 13, in the portions where the inverted-crown portion C2 of the fixing roller 21 presses against the crown portion D1 of the pressure roller 22, the distance between the fixing nip N and the sheet guide member 23-1 is greater because the position of the fixing nip N relative to the sheet facing surface 23*a* of the sheet guide member 23 is higher than in the portions where the crown portion C1 of the fixing roller 21 presses against the inverted-crown portion D2 of the pressure roller 22. If the distance between the fixing nip N and the sheet facing surface 23*a*-1 of the sheet guide member 23-1 is uneven, the sheet guide member 23-1 may fail to guide the sheet P to the fixing nip N reliably. Therefore, in the fourth embodiment shown in FIG. 14, the sheet facing surface 23*a*-1 of the sheet guide member 23-1 is curved along the shape of the fixing nip N to reduce fluctuations in the distance between the fixing nip N and the sheet facing surface 23*a*-1 of the sheet guide member 23-1 across the entire axial length, thereby facilitating the guide of the sheet P to the fixing nip N.

Because the sheet facing surface 23*a*-1 of the sheet guide member 23-1 is closer to the pressing roller 22 than the curve reference surface Z also in this embodiment, the contact between the sheet P being curved by the fixing nip N and the sheet guide member 23-1 can be prevented.

Fifth Embodiment

A fixing device 27D according to a fifth embodiment of the present embodiment is described below with reference to FIGS. 17 through 19.

Figure 17:
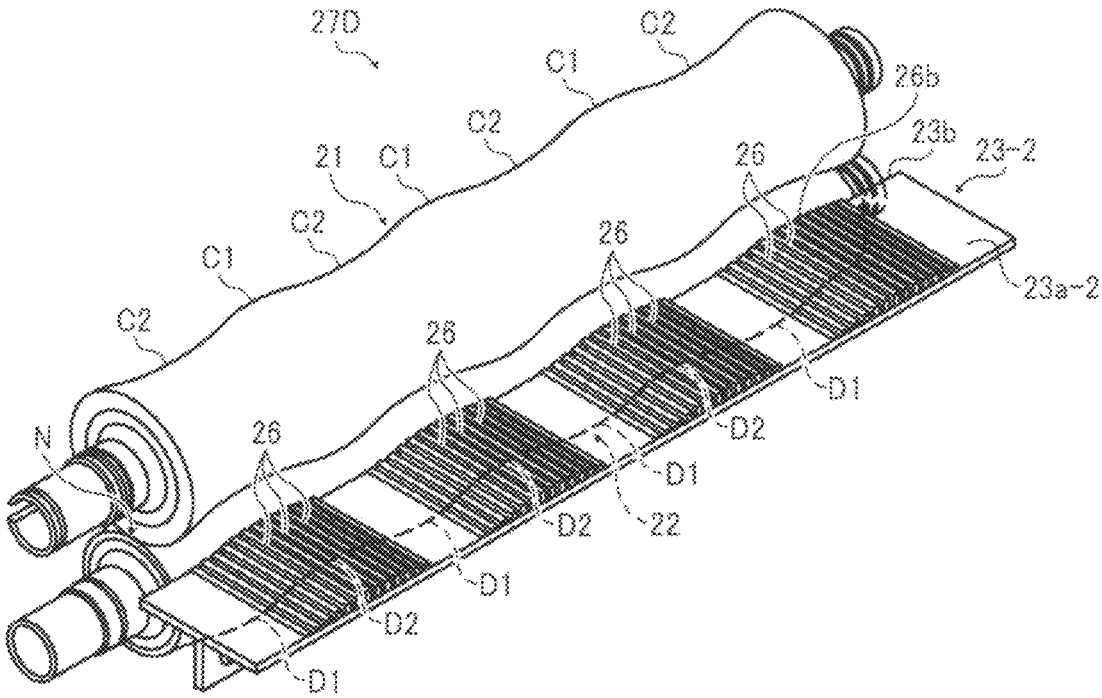
FIG. 17 is a perspective view illustrating a fixing device according to a fifth embodiment.
Figure 18:
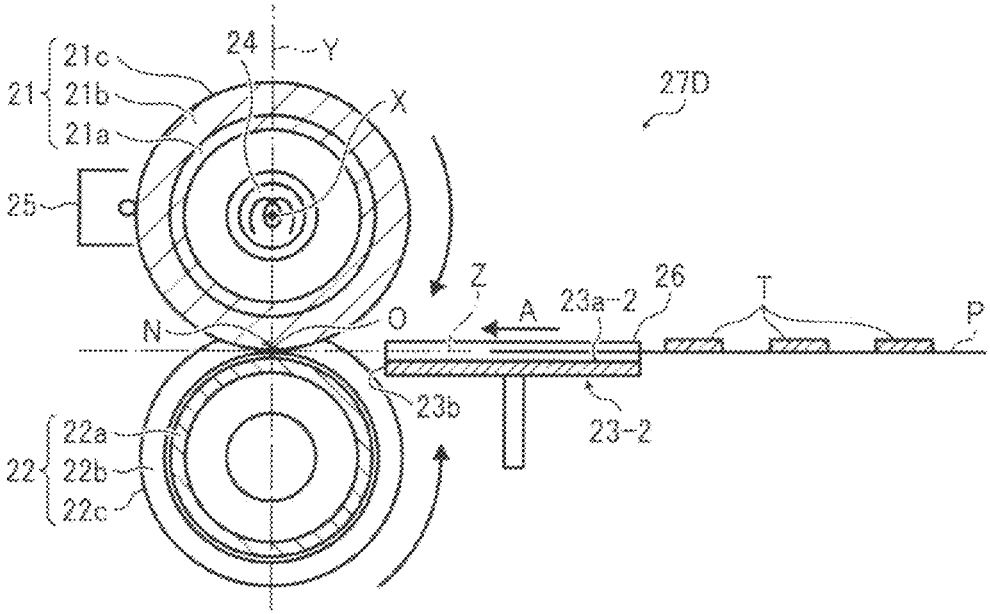
FIG. 18 is an end-on cross-sectional view illustrating the fixing device shown in FIG. 17.

As shown in FIG. 17, a sheet guide member 23-2 in the fifth embodiment is different from that in the third or fourth embodiment. More specifically, multiple projections 26 projecting toward the sheet transport path are formed on a sheet facing surface 23*a*-2 of the sheet guide member 23-2. The projections 26 are arranged in the axial direction or longitudinal direction of the fixing roller 21 and the pressing roller 22, and in the configuration shown in FIG. 17, each projection 26 extends in the sheet transport direction. The sheet facing surface 23*a*-2 of the sheet guide member 23-2 facing the sheet transport path is curved and wavy following the crown portions C1 and D1 and the inverted-crown portions C2 and D2, similarly to the configuration shown in FIG. 14.

Figure 19:
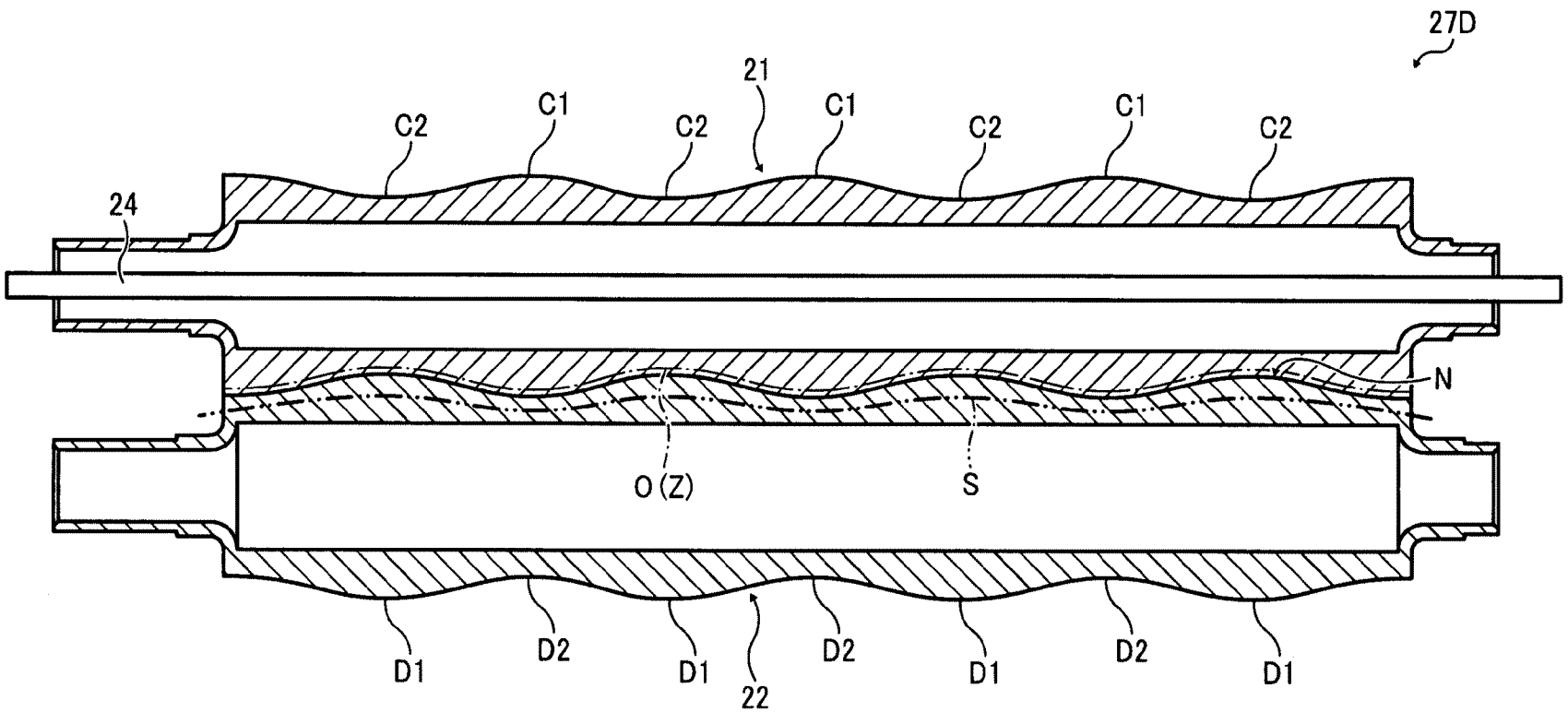
FIG. 19 is a front cross-sectional view illustrating the fixing device shown in FIG. 17.

In FIG. 19, alternate long and short dashed lines given a reference character S represents a virtual plane passing through apexes of the respective projections 26 (virtual line S). The sheet guide member 23-2 is configured so that the virtual line S conforms substantially to the shape (convexities and recesses) of the fixing nip N. In other words, the height, that is, a length in the direction of diameter of the fixing roller 21, of the apex of each projection 26 is set so that the virtual line S is curved corresponding to the shape of the fixing nip N.

Additionally, when the plane passing through both the axial line X of the fixing roller 21 and the centerline O of the fixing nip N in the sheet transport direction A is referred to as a plane Y, and a plane passing through the centerline O, perpendicular to the plane Y, is referred to as a curve reference plane Z, the virtual line S is positioned lower than the curve reference plane Z, similarly to the sheet facing surfaces 23*a* and 23*a*-1 in the third and fourth embodiments. Therefore, the sheet guide member 23-2 is disposed closer to the pressing roller 22 or farther from the fixing roller 21 than the curve reference plane Z is.

Other than the difference described above, the configuration of the fifth embodiment is similar to that of the above-described third embodiment, attaining similar effects, and thus description thereof is omitted.

In the fifth embodiment shown in FIG. 17, the height of the apex of each projection 26 is set to match the curved shape of the fixing nip N, which can reduce fluctuations in the distance between the fixing nip N and the sheet facing surface 23*a*-2 of the sheet guide member 23-2. With this configuration, the sheet P can be guided to the fixing nip N reliably similarly to the above-described fourth embodiment.

Additionally, because the multiple projections 26 are closer to the pressing roller 22 than the curve reference surface Z, contact between the sheet P being curved and the sheet guide member 23-2 (projections 26) can be prevented also in the fifth embodiment, attaining similar effects.

Moreover, because the sheet P contacts, that is, is guided by not a surface but the projections 26 in the fifth embodiment, the contact area between the sheet P and the sheet guide member 23-2 is reduced compared with the third or fourth embodiment in which a surface of the sheet guide member 23 contact the sheet P to guide the sheet P. Consequently, friction between the sheet P and the sheet guide member 23-2 can be reduced, facilitating sheet transportation. Additionally, any foreign substance (e.g., dust) adhering to the sheet P, if any, can drop between the projections 26 when it contacts the projection 26, and thus foreign substance entering the fixing nip N can be eliminated. Thus, fixing failure can be prevented.

Sixth Embodiment

A fixing device 27E according to a sixth embodiment of the present embodiment is described below with reference to FIGS. 20 through 23.

Figure 20:
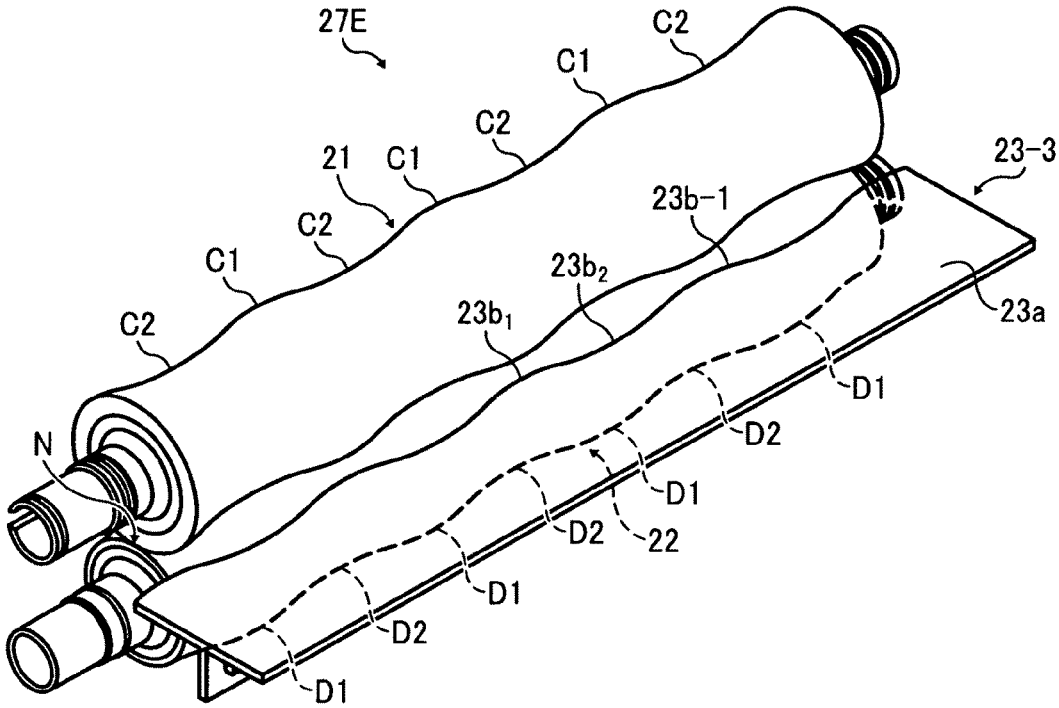
FIG. 20 is a perspective view illustrating a fixing device according to a sixth embodiment.
Figure 21:
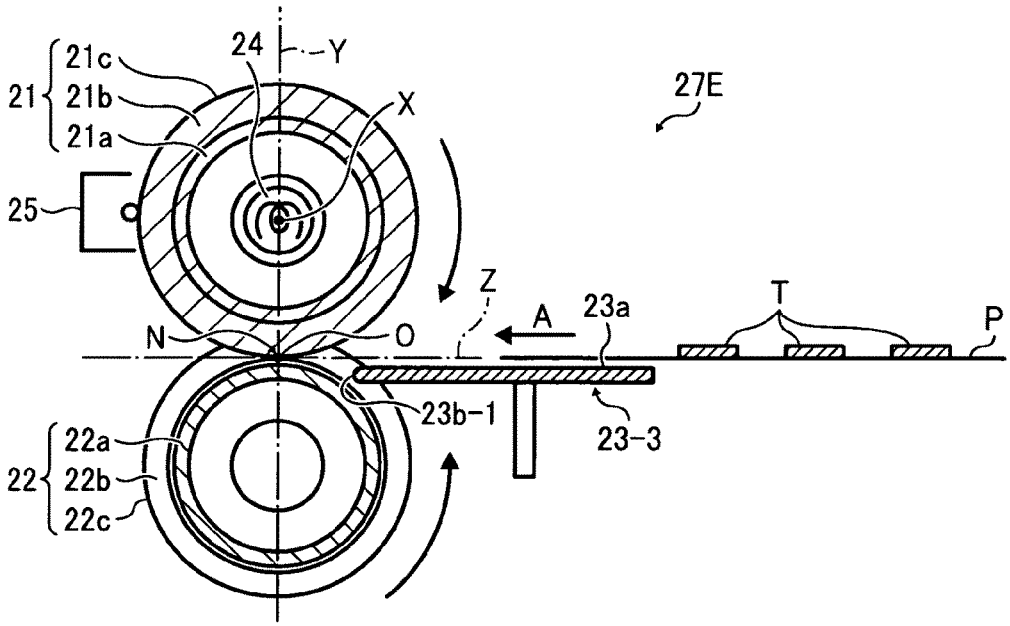
FIG. 21 is an end-on cross-sectional view illustrating the fixing device shown in FIG. 20.
Figure 22:
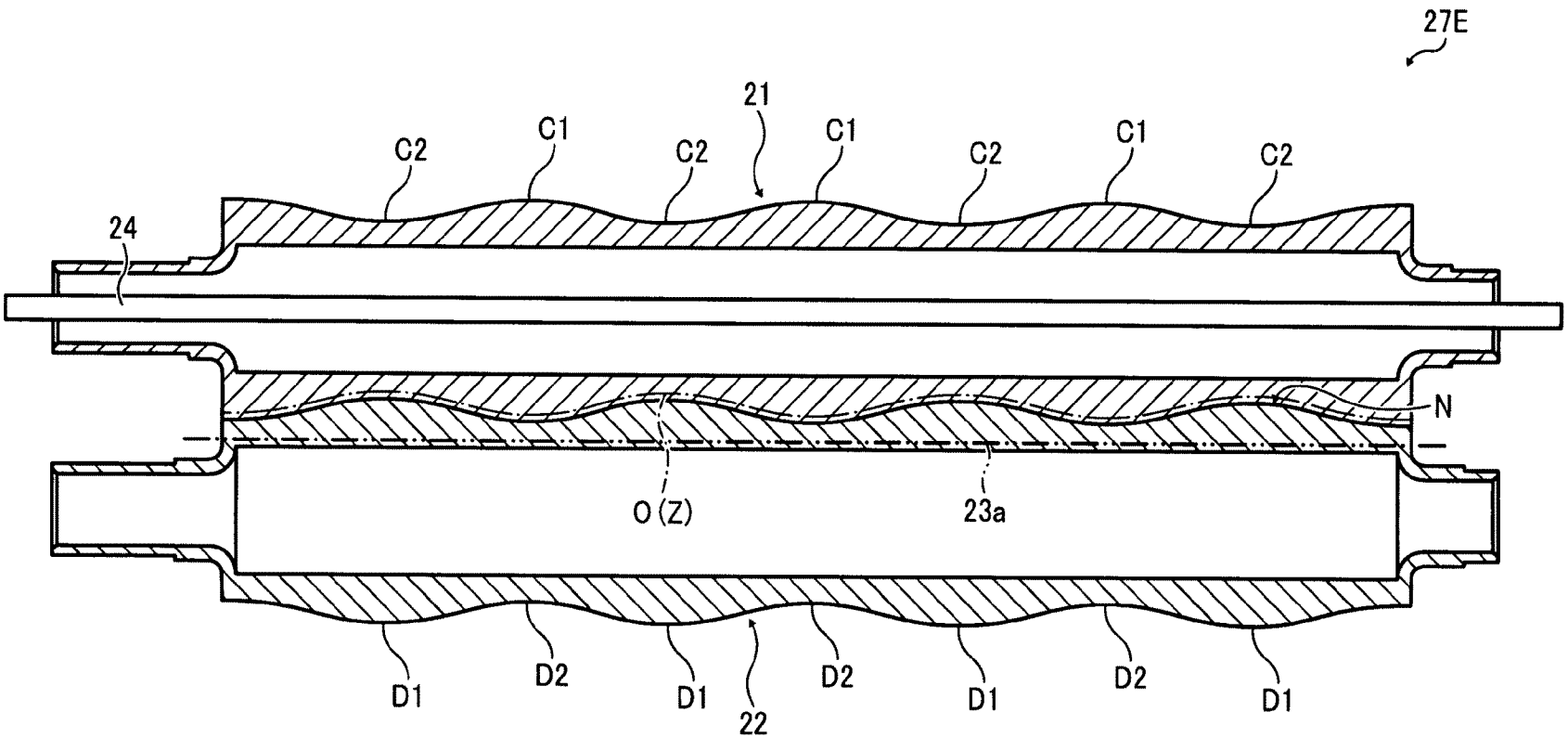
FIG. 22 is a front cross-sectional view illustrating the fixing device shown in FIG. 20.
Figure 23A:
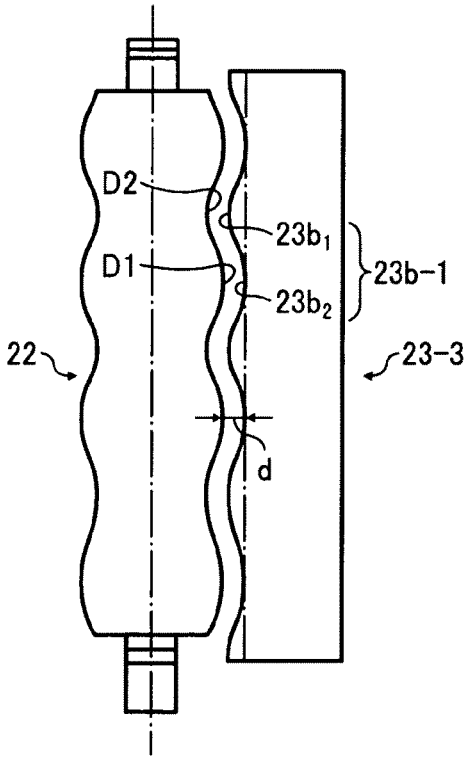
FIG. 23A is a schematic diagram illustrating the fixing device shown in FIG. 20 from above.

As shown in FIG. 20, in the present embodiment, a downstream edge portion or downstream edge surface 23*b*-1 of a sheet guide member 23-3 is curved or wavy in the sheet transport direction indicated by arrow A to approach or be away from the pressing roller 22, following the crown portions D1 and the inverted-crown portions D2 of the pressing roller 22. More specifically, the downstream edge portion 23*b*-1 includes convexities $23b_1$ and concavities $23b_2$ arranged alternately in the longitudinal direction of the sheet guide member 23-3, perpendicular to the sheet transport direction. As shown in FIG. 23A, the convexities $23b_1$ and the concavities $23b_2$ of the sheet guide member 23-3 are provided corresponding to the respective inverted-crown portions D2 and the crown portions D1 of the pressing roller 22, respectively. When the downstream edge portion 23*b*-1 is curved along the external surface of the pressing roller 22, the downstream edge portion 23*b*-1 can be closer to the external surface of the pressing roller 22 compared with a case in which the downstream edge of the sheet guide member 23-3 is flat, that is, straight in the sheet transport direction, as indicated by chain double-dashed line shown in FIG. 23A.

Further, when the lengths by which the downstream edge portion 23*b*-1 projects and is recessed (projection length and recessed length) are similar to the lengths by which the external surface of the pressing roller 22 projects and is recessed in the corresponding portions, a distance d, shown in FIG. 23A, between the downstream edge portion 23*b*-1 and the pressing roller 22 can be uniformed across the entire axial length. Accordingly, the downstream edge portion 23*b*-1 can be closer to the pressing roller 22.

Figure 23B:
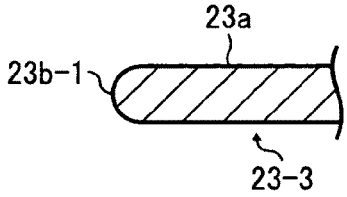
FIG. 23B illustrates a cross section of a sheet guide member perpendicular to an axial line of the fixing roller.

FIG. 23B illustrates a cross section of the sheet guide member 23-3 perpendicular to the axial line of the pressing roller 22 although they are not shown in FIG. 23B.

Additionally, the shape of the downstream edge portion 23*b*-1 in a given cross section perpendicular to the axial line of the pressing roller 22 is curved inward or outward and thus is may be edgeless. With this configuration, while the pressing roller 22 is driven, even when the pressing roller 22 is vibrated, causing the pressing roller 22 to contact the downstream edge portion 23*b*-1 of the sheet guide member 23-3, damage to the pressing roller 22 can be prevented or reduced. In addition, when the downstream edge portion 23*b* is curved, the toner or paper dust are less likely to adhere to the surface of the downstream edge portion 23*b*, and accordingly the sheet P can be kept clean. Alternatively, to prevent or reduce adhesion of the toner and/or paper dust to the sheet guide member 23-3, the downstream edge portion 23*b*-1 may be coated with a thin layer such as fluorine resin at least partly.

Other than the difference described above, the configuration of the sixth embodiment is similar to that of the above-described third embodiment, attaining similar effects, and thus description thereof is omitted.

In the sixth embodiment shown in FIG. 20, because the downstream edge portion 23*b*-1 is curved along the shape of the external surface of the pressing roller 22, the downstream edge portion 23*b*-1 can be closer to the external surface of the pressing roller 22. Therefore, impact on the sheet P when the sheet P contacts the pressing roller 22 can be alleviated, which can reduce damage to sheet P and/or the image formed thereon.

As described above, when the downstream edge portion 23*b*-1 of the sheet guide member 23-3 is curved along the external shape (crown portion D1 and inverted-crown portion D2) of the pressing roller 22, the distance d shown in FIG. 23A between the downstream edge portion 23*b*-1 and the pressing roller 22 can be uniformed across the entire axial length. Accordingly, the downstream edge portion 23*b*-1 can be closer to the pressing roller 22.

Thus, in the fifth embodiment, impact on the sheet P can be reduced, and disturbance in the image and wrinkles on the sheet P can be reduced efficiently.

Seventh Embodiment

A fixing device 27F according to a seventh embodiment is described below with reference to FIGS. 24 through 26.

Figure 24:
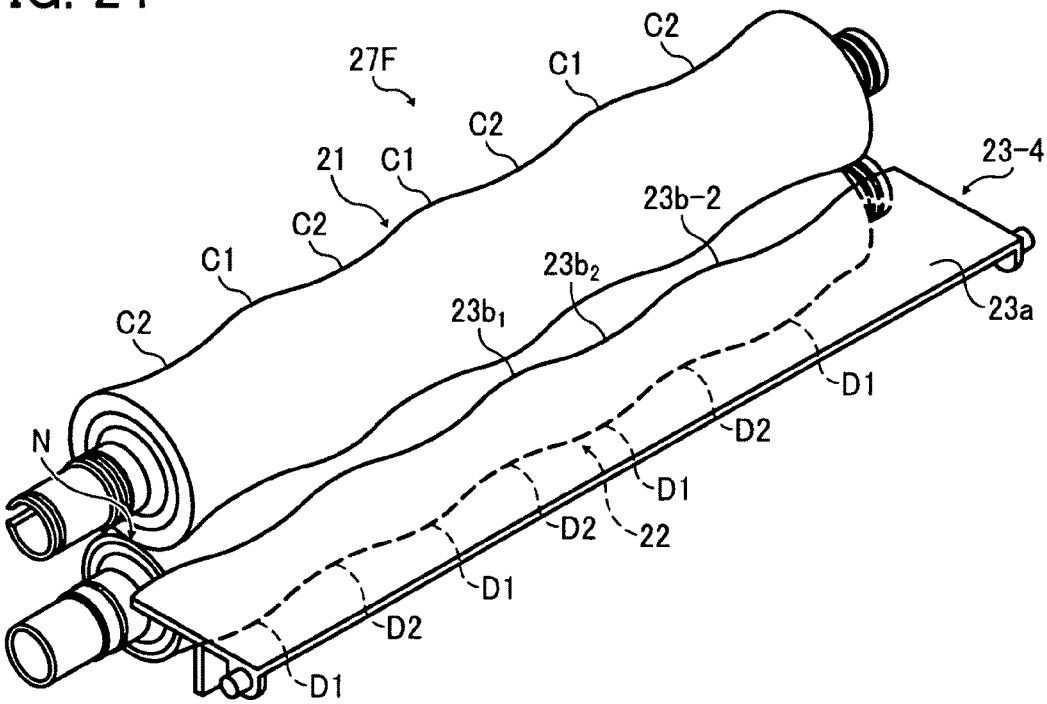
FIG. 24 is a perspective view illustrating a fixing device according to a seventh embodiment.

As shown in FIG. 24, in the fixing device 27F according to the seventh embodiment, similarly to the sixth embodiment shown in FIGS. 20 through 23, a downstream edge portion 23*b*-2 of a sheet guide member 23-4 is curved to approach or be away from the pressing roller 22, following the crown portions D1 and the inverted-crown portions D2 of the pressing roller 22. Accordingly, also in the present embodiment, the downstream edge portion 23*b*-2 of the sheet guide member 23-4 includes convexities $23b_1$ and the concavities $23b_2$ formed corresponding to the respective inverted-crown portions D2 and the crown portions D1 of the pressing roller 22, respectively.

Figure 25:
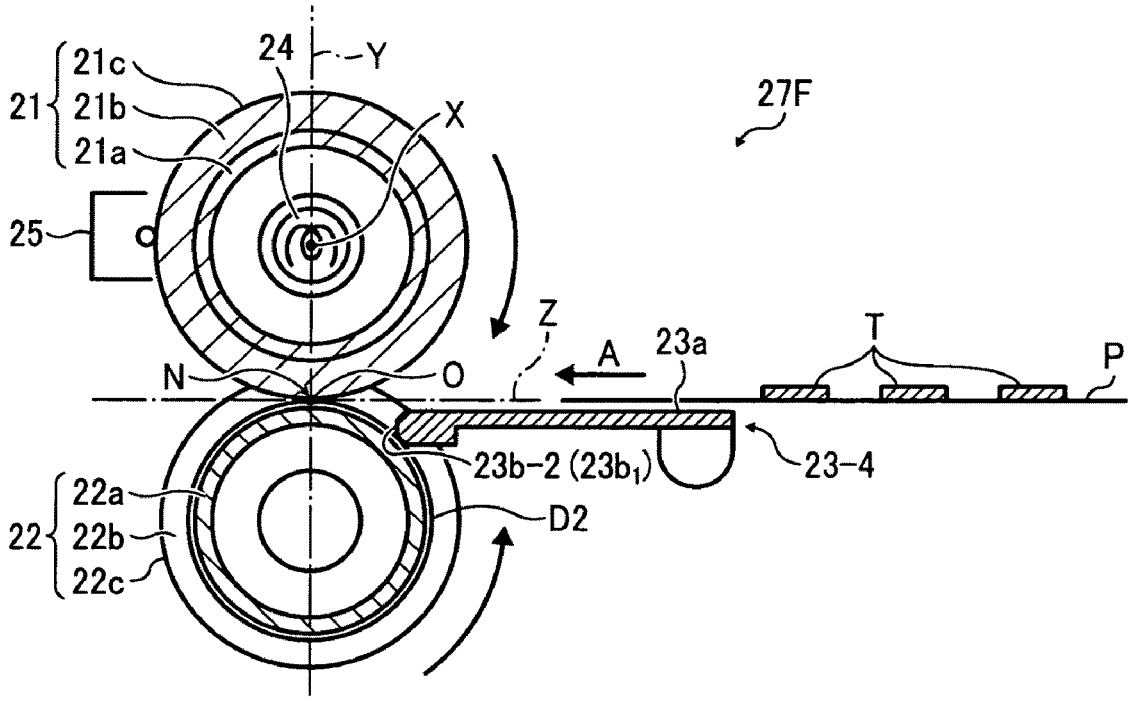
FIG. 25 is an end-on cross-sectional view illustrating the fixing device shown in FIG. 24.
Figure 26:
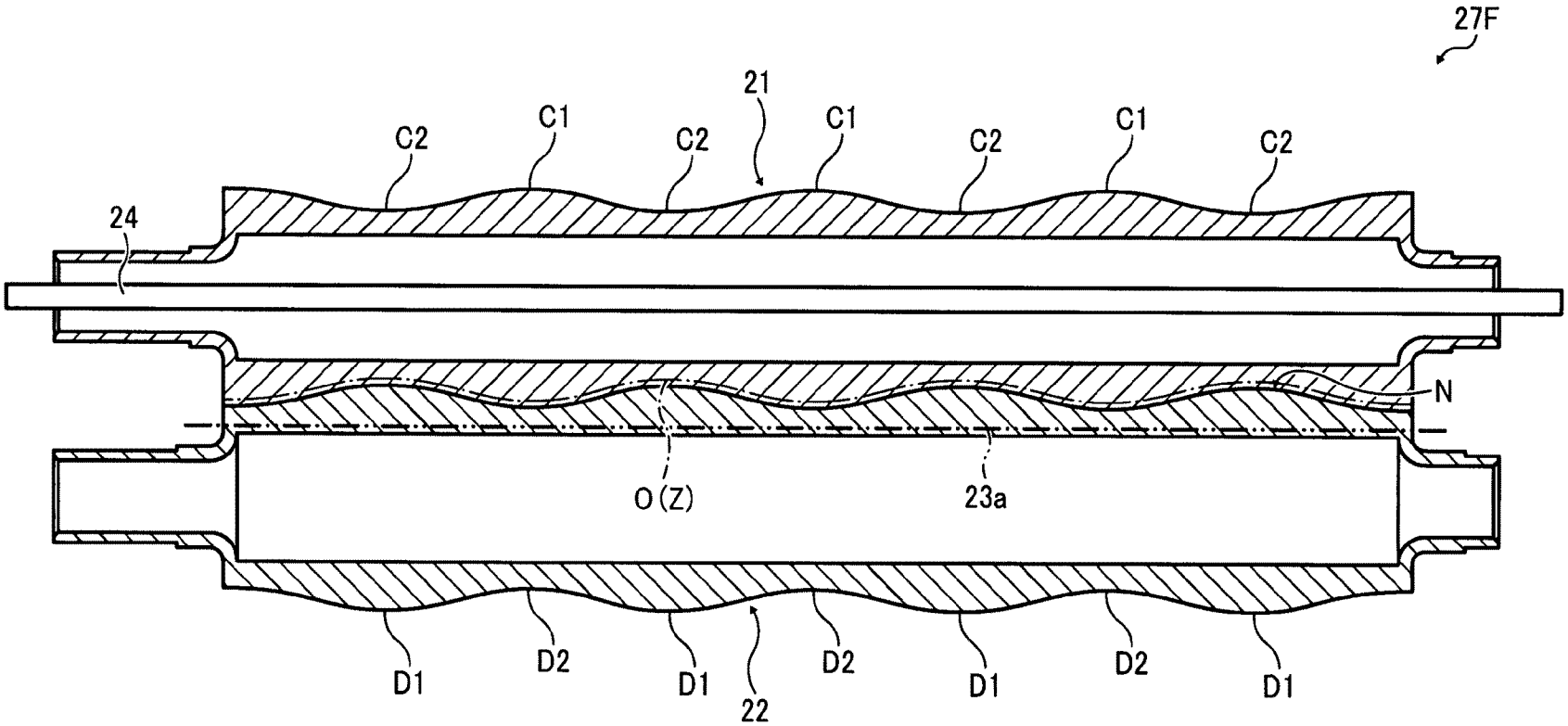
FIG. 26 is a front cross-sectional view illustrating the fixing device shown in FIG. 24.

Further, as shown in FIG. 25, the convexities $23b_1$ of the downstream edge portion 23*b*-2 are in contact with the respective inverted-crown portions D2 of the pressing roller 22 in the present embodiment. With this configuration, even when the pressing roller 22 is vibrated, the downstream edge portion 23*b*-2 of the sheet guide member 23-4 can follow the movement of the pressing roller 22, and thus the distance between the edge portion 23*b*-2 and the pressing roller 22 can be kept constant. It is to be noted that, alternatively, the concavities $23b_2$ of the downstream edge portion 23*b*-2 may be in contact with the respective crown portions D2 of the pressing roller 22 because the above-described effect can be attained as long as the downstream edge portion 23*b*-2 is partly in contact with the pressing roller 22.

Additionally, to protect the external circumferential surface of the pressing roller 22 from damage, the cross-sectional shape of the downstream edge portion 23*b*-2 may be curved or edgeless in the portions in contact with the pressing roller 22 similarly to the cross section shown in FIG. 23B.

Other than the difference described above, the configuration of the seventh embodiment is similar to that of the above-described third embodiment, attaining similar effects, and thus description thereof is omitted.

In the seventh embodiment shown in FIG. 25, because the downstream edge portion 23*b*-2 of the sheet guide member 23-4 is partly in contact with the surface of the pressing roller 22, even when the pressing roller 22 is vibrated, the downstream edge portion 23*b*-2 of the sheet guide member 23-4 can follow the movement of the pressing roller 22, and thus the distance between the edge portion 23*b*-2 and the pressing roller 22 can be kept constant. With this configuration, when the sheet P contacts the pressing roller 22, fluctuations in the impact on the sheet P can be reduced, and thus disturbance in the image and wrinkles on the sheet P can be reduced efficiently.

Eighth Embodiment

A fixing device 27G according to a eighth embodiment is described below with reference to FIGS. 27 through 28.

Figure 27:
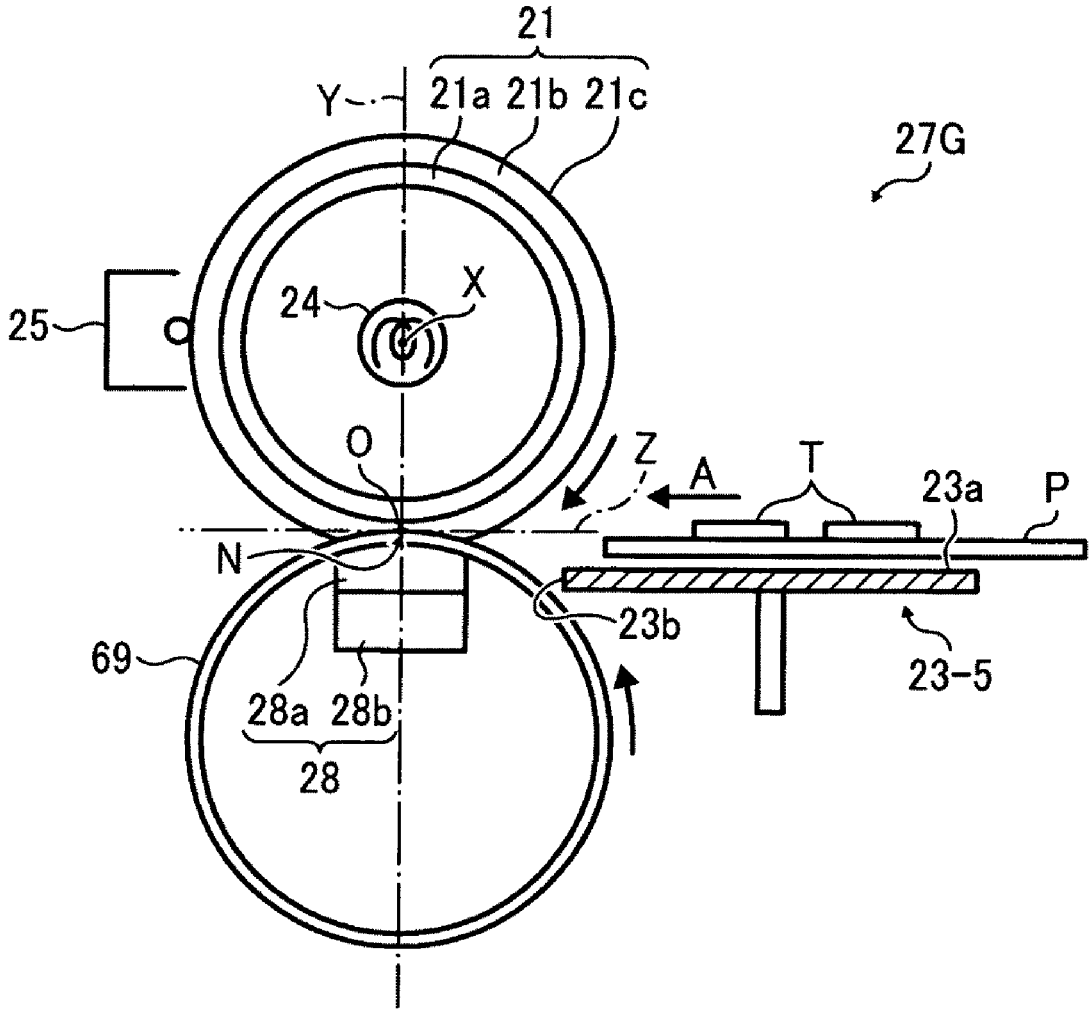
FIG. 27 is an end-on cross-sectional view illustrating a fixing device according to a seventh embodiment.
Figure 28:
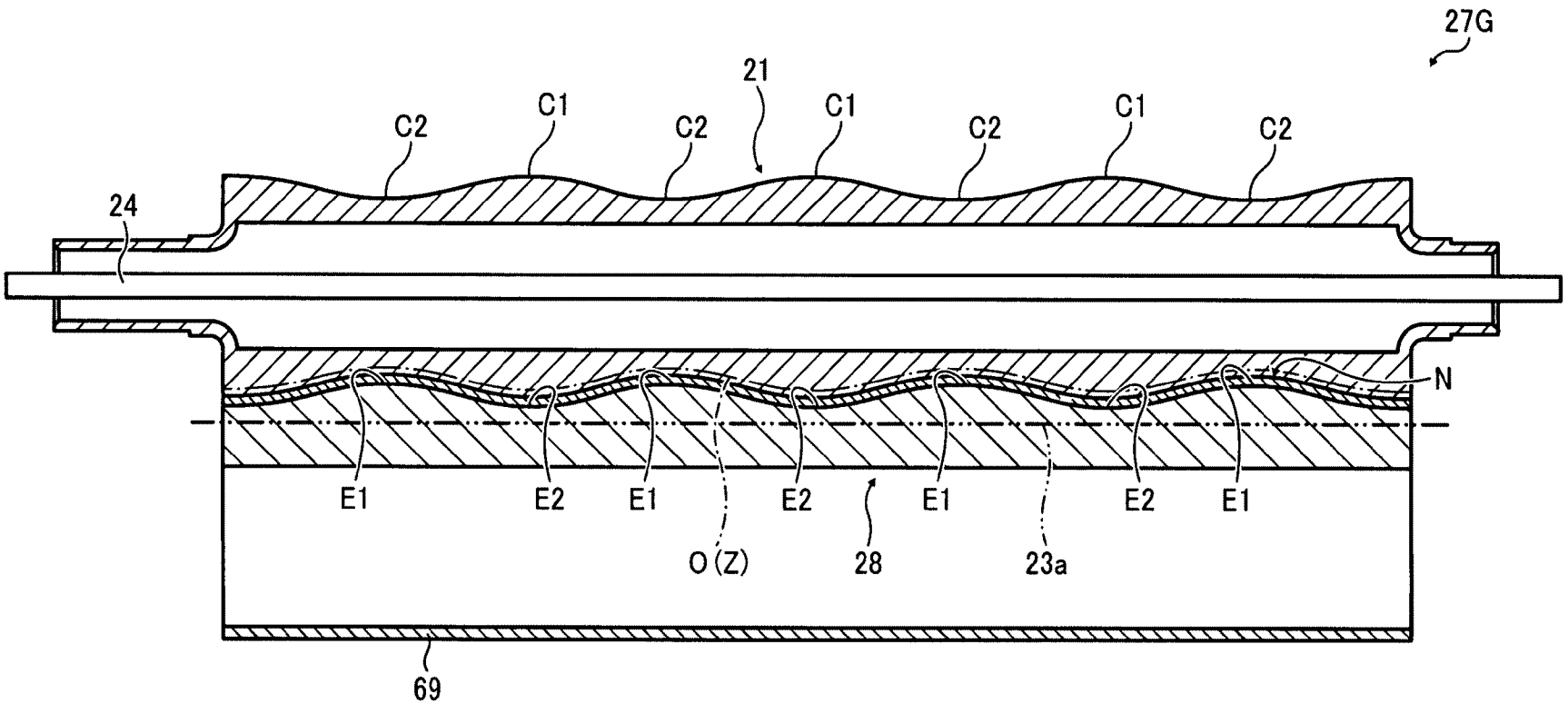
FIG. 28 is a front cross-sectional view illustrating the fixing device shown in FIG. 27.

As shown in FIGS. 27 and 28, the fixing device 27G does not include the pressing roller 22. Instead, the fixing device 27G includes a pressing belt 69 and a pressure member 28 together forming a pressing unit configured to press against a fixing roller 21. The fixing roller 21 includes a cylindrical metal core 21*a*, an elastic layer 21*b* lying over the metal core 21*a*, and a release layer 21*c* lying over the elastic layer 21*b*, similarly to the above-described first through seventh embodiments. Additionally, a heater 24 serving as a heat source is provided inside the fixing roller 21, and a temperature detector 25 is provided adjacent to the external circumferential surface of the fixing roller 21 to detect a surface temperature of the fixing roller 21. The pressing belt 69 is an endless belt formed of polyimide or the like. The pressure member 28 includes an elastic layer 28*a* formed by silicone rubber or the like and a holder 28*b* holding the elastic layer 28*a*. The elastic layer 28*a* of the pressure member 28 is in contact with an inner circumferential surface of the pressing belt 69, and a bias member, not shown, presses the pressure member 28 to the fixing roller 21 in this state. With this configuration, the pressure member 28 pushes the inner surface of the pressing belt 69, thereby pressing the pressing belt 69 against the fixing roller 21, and thus a fixing nip N is formed in a pressure contact area in which the fixing roller 21 and the pressing belt 69 pressing against each other.

In the fixing process performed by the fixing device 27G shown in FIG. 27, driven by a driving unit, not shown, the fixing roller 21 rotates clockwise in FIG. 27, which causes the pressing belt 69 to rotate counterclockwise in FIG. 27. A sheet P carrying an unfixed toner image T is transported in a sheet transport direction indicated by arrow A shown in FIG. 27 to the fixing nip N formed between the fixing roller 21 and the pressing roller 69 thus rotating. Then, the toner image T on the sheet P is fixed with heat and pressure in the fixing nip N.

The fixing roller 21 and the pressing member 28 are described in further detail below.

As shown in FIG. 28, on the external surface of the fixing roller 21, multiple crown portions C1 projecting outward in the direction of diameter and multiple inverted-crown portions C2 recessed inward in the direction of diameter are formed alternately in the axial direction, similarly to the above-described embodiments. As shown in FIG. 28, the pressure member 28 includes at least one convexity E1 curving outward to the pressing belt 69 and at least one recess (concavity) E2 recessed inward away from the pressing belt 69 formed on its surface configured to press against the fixing belt 69. In the configuration shown in FIG. 28, multiple convexities E1 and multiple recesses E2 are arranged alternately in the longitudinal direction of the pressure member 28. In the present embodiment, the crown portions E1 and the inverted-crown portions E2 are formed by varying the thicknesses of the elastic layers 28*a* in the longitudinal direction. Alternatively, the crown portions E1 and the inverted-crown portions E2 may be formed by varying the thicknesses of the holder 28*b* in the longitudinal direction.

Then, the fixing roller 21 and the pressing belt 69 are pressed against each other with the crown portions C1 of the fixing roller 21 fitted in the respective recesses E2 of the pressure member 28 and the convexities E1 of the pressure member 28 fitted in the respective inverted-crown portions C2 of the fixing roller 21. Thus, the fixing nip N is curved in the longitudinal direction as shown in FIG. 28.

The fixing device 27G shown in FIG. 27 further includes a sheet guide member 23 configured to guide the sheet P to the fixing nip N, similarly to the above-described third through seventh embodiments. Similarly to the configuration shown in FIG. 12, also in the present embodiment, when the plane passing through both the axial line X of the fixing roller 21 and the centerline O of the fixing nip N in the sheet transport direction A is referred to as a plane Y, and a plane passing through the centerline O, perpendicular to the plane Y, is referred to as a curve reference plane Z, a sheet facing surface 23*a* of the sheet guide member 23 is disposed lower than the curve reference plane Z is. Therefore, the sheet guide member 23 is disposed closer to the pressing belt 69 or farther from the fixing roller 21 than the curve reference plane Z is.

It is to be noted that, although the sheet facing surface 23*a* of the sheet guide member 23 is flat in this embodiment, alternatively, the facing surface 23*a* may be curved corresponding to the shape of the fixing nip N similarly to the fourth embodiment shown in FIG. 14. Alternatively, similarly to the fifth embodiment shown in FIG. 17, the multiple projections 26 projecting toward the sheet transport path may be formed on the sheet facing surface 23*a* of the sheet guide member 23.

It is to be noted that, in the above-described third through eighth embodiments, although the sheet facing surface 23*a* of the sheet guide member 23 is entirely closer to the pressing roller 22 than the curve reference surface Z to prevent the contact between the curved sheet P and the sheet guide member 23 in the above-described third through eighth embodiments, alternatively, only a part of the sheet facing surface 23*a* including the downstream edge portion 23*b* may be closer to the pressing roller 22 than the curve reference surface Z as long as the contact between the curved sheet P and the sheet guide member 23 is prevented. Additionally, when the multiple projections 26 are formed on the sheet guide member 23 as in the configuration shown in FIG. 17, only the downstream edge portion 26*b* may be closer to the pressing roller 22 than the curve reference surface Z is.

Next, the relation between the number of waves of the fixing nip and the apparent stiffness of the sheet discharged from the fixing nip is described in further detail below.

To examine the relation, the following experiment was performed using the fixing device 27 shown in FIG. 3 according to the first embodiment in which the crown portions 61*a* and the inverted-crown portions 61*b* were provided in the fixing roller 61 and crown portions 62*a* and the inverted-crown portions 62*b* were provided in the fixing roller (or the pressure member) and a comparative example 1 in which a fixing roller and a pressing roller include no crown portions and no inverted-crown portions. As the fixing devices 27, two different types, type A in which the number of the crown portions and the inverted-crown portions is three and type B in which the number of the crown portions and the inverted-crown portions is seven, were used.

It is to be noted that, although the experiment was performed using the fixing device 27, similar results may be obtained when any of the fixing devices 27A through 27G is used.

The amplitudes of the crown portions and the inverted-crown portions in the two types of the fixing devices 27 were 0.2 mm. The thickness of the elastic layers 612 of the fixing roller 61 and the pressing roller 62 was 1.7 mm in all fixing devices used in the experiment. The apparent stiffness of sheets S1, S2, and S3 of different three types of paper whose weight per square meters are respectively 64 g, 69 g, and 90 g were measured when those sheets were discharged from the two types of the fixing devices 27 and the comparative example 1. It is to be noted that hereinafter the sheets S1, S2, and S3 may be referred to as the sheets S collectively.

Figure 29:
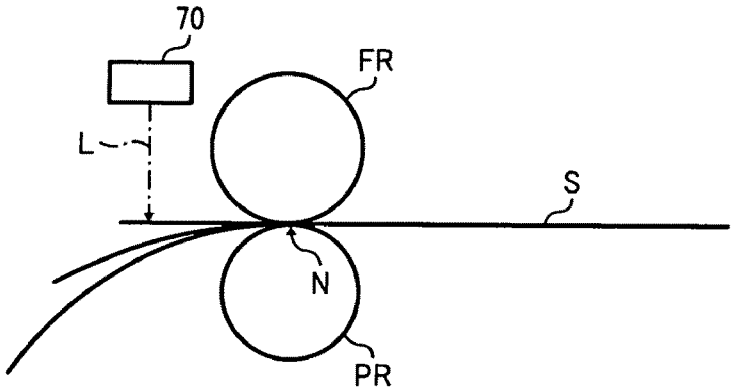
FIG. 29 is a schematic diagram illustrating apparent stiffness of a sheet passing through a fixing nip.

The apparent stiffness of sheets was measured as follows: Initially, as shown in FIG. 29, the sheet S was transported through the fixing nip N between the fixing roller FR and the pressing roller PR, and transportation of the sheet S was stopped when a displacement detector 70 emitted a laser beam L to a leading edge portion of the sheet S. After the sheet S stopped vibrating, the displacement detector 70 emitted the laser beam L to the curved sheet S and measured the displacement of the sheet S. Subsequently, after the sheet S was transported a predetermined or given distance, the displacement detector 70 again emitted the laser beam L to the curved sheet S and measured the displacement of the sheet S. The apparent stiffness of sheet S was calculated based on the displacement of the sheet S.

Figure 30:
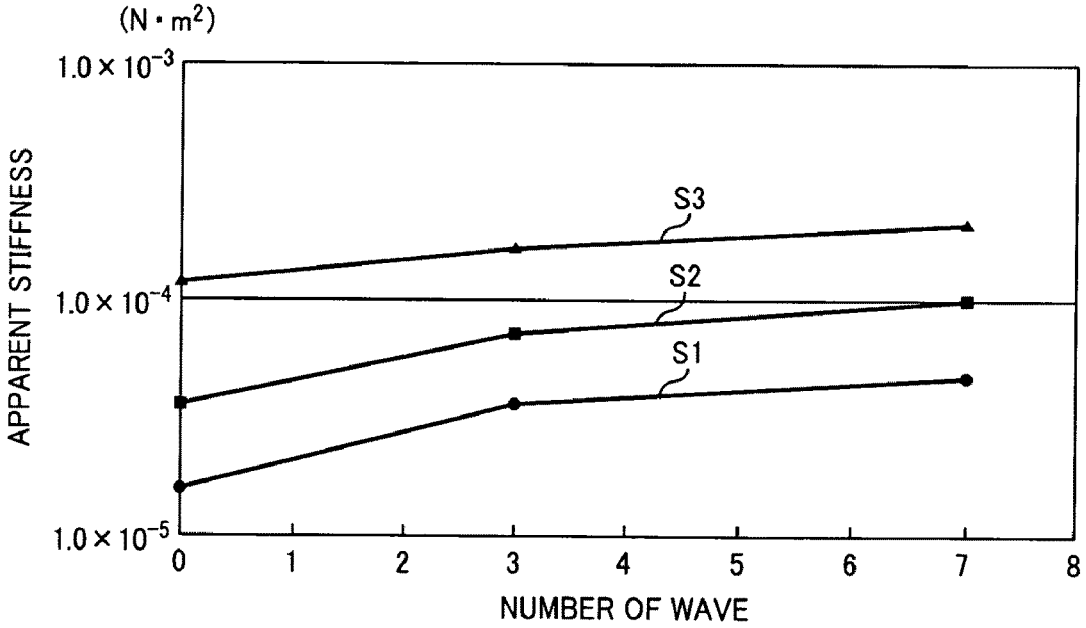
FIG. 30 is a graph illustrating the relation between the number of waves and the apparent stiffness of sheets.

FIG. 30 is a graph illustrating the relation between the number of waves of the fixing nip and the apparent stiffness of the respective sheets. FIG. 30, a vertical axis represents the apparent stiffness of the respective sheets, and a horizontal axis represents the number of waves of the nixing nip.

It is to be noted that the number of waves means the number of the crown portions and the inverted-crown portions.

More specifically, the number of waves of the fixing nip is respectively zero and three when no crown portions and no inverted-crown portions are provided and when three crown portions and three inverted-crown portions are provided. Additionally, in FIG. 30, line plots within reference characters S1, S2, and S3 represent the measured apparent stiffness of the sheet S1 whose weight per square meters is 64 g, the sheet S2 whose weight per square meters is, 69 g, and the sheet S3 whose weight per square meters is 90 g, respectively.

As shown in the graph of FIG. 30, the apparent stiffness of the sheet S was greater in the A type and B type of the fixing devices 27 according to the above-described embodiments, in which the number of waves of the fixing nip was respectively three and seven, than in the comparative example 1 in which the number of waves of the fixing nip was zero. Additionally, the apparent stiffness of the sheet S was greater in the type B in which the number of waves of the fixing nip was seven than in the type A in which the number of waves of the fixing nip was three. Therefore, increasing the number of waves of the fixing nip can increase the apparent stiffness of the sheet S.

It is to be noted that, although the results shown in FIG. 30 show effects of enhancing the apparent stiffness of the sheet in one of the above-described embodiments, similar effects can be obtained in other embodiments.

As described above, it is preferred to set the difference in height between the apex of the crown portions 61*a* and 62*a* and the bottom of the inverted-crown portions 61*b* and 62*b* to a range from 0.16 mm to 0.8 mm in the contact state with pressure to attain a sufficient apparent stiffness of the sheet so that the sheet can be prevented from both winding around the fixing roller 61 and wrinkling. Thus, in this configuration, reliable image formation can be attained.

Additionally, to separate the sheet from the fixing nip without causing the sheet to wrinkle, it is preferred that the crown portions 61*a* or 62*a* and the inverted-crown portions 61*b* or 62*b* be formed continuously in the axial direction in each of the fixing roller 61 and the pressing roller 62. If the crown portions and the inverted-crown portions are not continuous, for example, the adjacent crown portion 61*a* or 62*a* and the inverted-crown portion 61*b* or 62*b* adjacent thereto are positioned across a given distance from each other, in the axial direction, the sheet can wrinkle while being transported.

It is to be noted that, also in the configurations using the pressing belt 69 shown in FIGS. 9 and 27, it is preferred that the crown portions 61*a* or C1 and the inverted-crown portions 61*b* or C2 be continuous in the axial direction in the fixing roller 61 and the convexities 70*a* or E1 and recesses 70*b* or E2 be continuous in the pressure member 70 or 28 from the similar reason.

Another experiment was performed to compare the separation of the sheet from the fixing roller in a comparative example 2 in which either one crown portion or one inverted-crown portion is formed in the fixing roller and the pressing roller and a configuration in which one crown portion as well as one inverted-crown portion are formed in the fixing roller and the pressing roller similarly to the any of the above-described embodiments, in which at least one crown portion and at least one inverted-crown portion are formed.

Figure 31A:
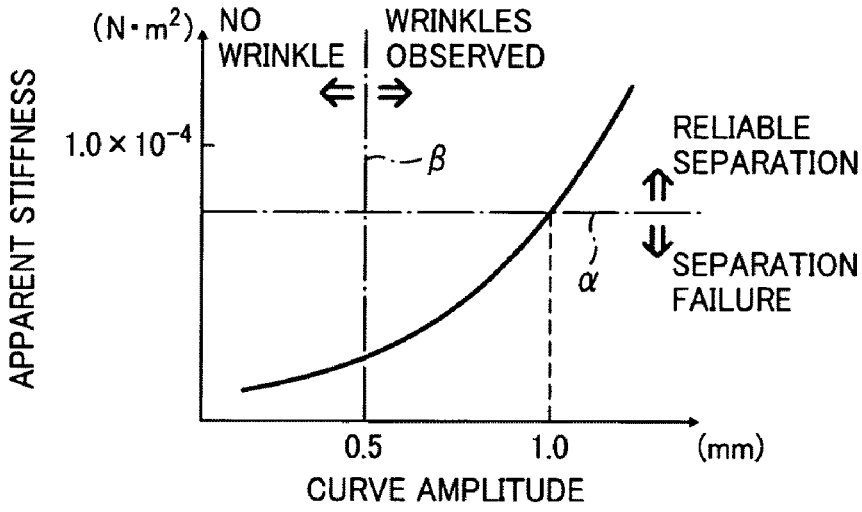
FIGS. 31A and 31B respectively show results of an experiment to example separation of sheets in a comparative fixing device including either one crown portion or one inverted-crown portion and that in a configuration in which one crown portion as well as one inverted-crown portion are provided.
Figure 31B:
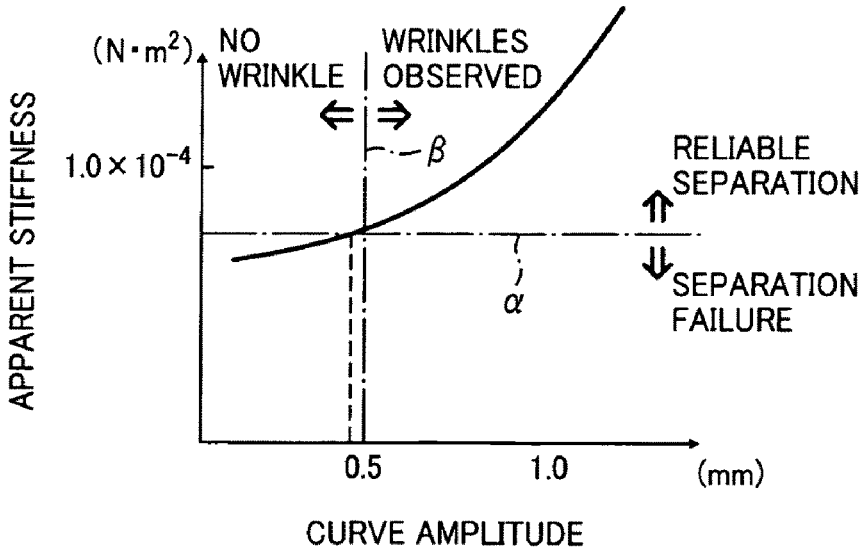

FIGS. 31A and 31B respectively show results in the comparative example 2 in which either one crown portion or one inverted-crown portion is formed and a configuration in which one crown portion as well as one inverted-crown portion are formed. In FIGS. 31A and 31B, a vertical axis represents the apparent stiffness of the respective sheets, and a horizontal axis represents the amplitude of curve of the fixing nip, that is, the height of the crown portion and the inverted-crown portion. Additionally, in FIGS. 31A and 31B, alternate long and short dashed lines a is a border of the apparent stiffness (e.g., a threshold apparent stiffness) between reliable separation of sheet from the fixing roller and separation failure, and alternate long and short dashed lines β is a border of the amplitude of the crown portion and the inverted-crown portion (e.g., a threshold amplitude) regarding wrinkles in the sheet. More specifically, although the sheet can be separated from the fixing roller reliably when the apparent stiffness of the sheet is greater than the threshold α, the sheet cannot be separated from the fixing roller reliably when the apparent stiffness of the sheet is smaller than the threshold α. Further, although the sheet wrinkles when the amplitude of the crown portion and the inverted-crown portion is greater than the threshold β, the sheet is free of wrinkles when the amplitude is smaller than the threshold β.

As shown in FIG. 31A, in the comparative example 2 including either the crown portion or the inverted-crown portion, to increase the apparent stiffness of the sheet above the threshold a for the reliable separation of sheet, the amplitude of the crown portion, etc., should be greater than 1.0 mm. However, in such a case, the sheet is likely to wrinkle. By contrast, as shown in FIG. 31B, in the configuration including one crown portion and one inverted-crown portion, the apparent stiffness of the sheet is greater even when the amplitude is identical to that in the comparative example 2 shown in FIG. 31A. Therefore, in the configuration including one crown portion and one inverted-crown portion, as shown in FIG. 31B, the apparent stiffness of the sheet can be greater than the threshold a while the amplitude of the crown portion and the inverted-crown portion is can be within a range from 0.45 to 0.5 mm with which wrinkles in the sheet can be prevented or inhibited. As described above, when at least crown portion and at least one inverted-crown portion are provided, the apparent stiffness of sheet is greater than that in the comparative example 2 in which either one crown portion or one inverted-crown portion is provided. Therefore, when at least crown portion and at least one inverted-crown portion are provided, both the reliable separation of sheet and elimination of wrinkles in sheets can be attained.

Therefore, a specific feature of the above-described embodiments of the present invention is that each of the fixing roller and the pressing roller includes at least crown portion and at least one inverted-crown portion. Additionally, the apparent stiffness of sheet can be further increased by increasing the number of the crown portions and the inverted-crown portions, thus further improving the separation of sheet.

It is to be noted that, although the results shown in FIGS. 31A and 31B show effects of enhancing the apparent stiffness of the sheet in one of the above-described embodiments, similar effects can be obtained in other embodiments.

A comparative example 3 in which only one of the fixing roller and the pressing roller includes the crown portion and the inverted-crown portion and the other has an external surface straight in the axial direction is described below.

In the comparative example 3, when the fixing roller and the pressing roller are pressed against each other, the curve of the crown portion and the inverted-crown portion is compressed on the straight surface, and accordingly differences in the contact pressure in the fixing nip in the axial direction are increased. If the differences in the contact pressure in the fixing nip are greater, a certain area of the image that has passed through a portion with a higher contact pressure has a higher degree of gross while a certain area of the image that has passed through a portion with a lower contact pressure has a lower degree of gross. That is, the degree of gross is uneven in the fixed image.

By contrast, the fixing device 27 according to the first embodiment, the fixing roller 61 and the pressing roller 62 are pressed against each other with the crown portions 61*a* and 62*a* fitted in the inverted-crown portion 61*b* and 62*b*. In the fixing device 27A according to the second embodiment, the fixing roller 61 and the pressure member 70 press against each other while the crown portions 61*a* of the fixing roller 61 correspond to the respective recesses 70*b* of the pressure member 70 and the inverted-crown portions 61*b* of the fixing roller 61 correspond to the respective convexities 70*a* of the pressure member 70. Thus, the fixing nip is formed by fitting the convexities or the crown portions in the concavities or the inverted-crown portions, and differences in the contact pressure in the fixing nip can be reduced. As a result, unevenness in the gross of the fixed image can be reduced, enhancing the image quality.

However, if gaps are created between the crown portions 61*a* or 62*a* and the corresponding inverted-crown portion 62*b* or 61*b* when the fixing roller 61 and the pressure roller 62 are in contact with each other without pressure, the contact pressure in the fixing nip is uneven in the axial direction when the fixing roller 61 and the pressure roller 62 are in contact with each other with a certain degree of pressure, generating noise in images. Therefore, the fixing roller 61 and the pressing roller 62 are configured so that no gaps are created between the crown portions 61*a* and 62*a* and the corresponding inverted-crown portions 61*b* and 62*b* in the contact state without pressure. Therefore, image noise can be prevented while the sheet can be separated from the fixing roller 61 reliably. The configurations using the pressing belt 69 shown in FIGS. 9 and 27 have the above-described feather similarly. Therefore, also in the second and eighth embodiments, it is preferred that the fixing roller 61 or 21 and the pressure member 70 or 28 be configured so that no gaps are created between the crown portions 61*a* and C1 and the corresponding recesses 70*b* and E2, respectively, in the contact state without pressure.

Additionally, it is preferred that the sum of the thicknesses of the elastic layer 612 of the fixing roller 61 and the elastic layer 622 of the pressing roller 62 at the identical position in the axial direction be constant across the entire axial length or image area when the fixing roller 61 and the pressing roller 62 are disposed with the crown portions 61*a* and 62*a* fitted in the corresponding inverted-crown portions 61*b* and 62*b*. If the sum of the thicknesses of the elastic layers 612 and 622 is not constant, peak of the pressure in the direction of rotation of the fixing roller 61 and the pressing roller 62 is different in the axial direction, that is, the contact pressure in the fixing nip is not uniform. As a result, image noise is caused. Also in the configurations using the pressing belt 69 shown in FIGS. 9 and 27, it is preferred that the sum of the thicknesses of the elastic layers 612 (or 21*b*) of the fixing roller 61 (or 21) and 701 (or 28*a*) of the pressure member 70 (or 28) at the identical position in the axial direction be constant across the entire axial length or image area when the fixing roller 61 (or 21) and the pressure member 70 (or 28) are disposed with the crown portions 61*a* (or C1) fitted in the corresponding recesses 70*b* (or E2) from the similar reason.

It is to be noted that the fixing roller 61 (or 21) expands in the axial direction due to thermal expansion when heated to the predetermined fixing temperature. If such expansion causes displacement between the crown portion and the corresponding inverted-crown portion, the difference in the contact pressure in the fixing nip can increase, which is not desirable. Therefore, the end portions of the fixing roller 61 and the pressing roller 62 on the same side in the axial direction are fixed, and the other end portions are movable in the axial direction as shown in FIG. 4. With this configuration, even when the fixing roller 61 expands in the axial direction due to thermal expansion, the fixing roller 61 and the pressing roller 62 can expand toward an identical side, inhibiting the displacement between the crown portion and the corresponding inverted-crown portion. Accordingly, the difference in the contact pressure in the fixing nip can be inhibited.

Similarly, in the second and eighth embodiments, the end portions of the fixing roller 61 (or 21) and the pressure member 70 (or 28) on the same side in the axial direction are fixed while the other end portions are movable in the axial direction to prevent the difference in the contact pressure in the fixing nip caused by the thermal expansion of the fixing roller 61.

Herein, although the description above concerns reducing differences in the contact pressure in the fixing nip for reliable image formation, it is also important to equalize the temperature in addition to the contact pressure in the fixing nip for the reliable image formation with uniform gross. However, in the above-described embodiments, the thickness of the fixing roller 61 is different in the axial direction because of the crown portions 61*a* and the inverted-crown portions 61*b*, which can cause the surface temperature of the fixing roller 61 to fluctuate in the axial direction.

Figure 32:
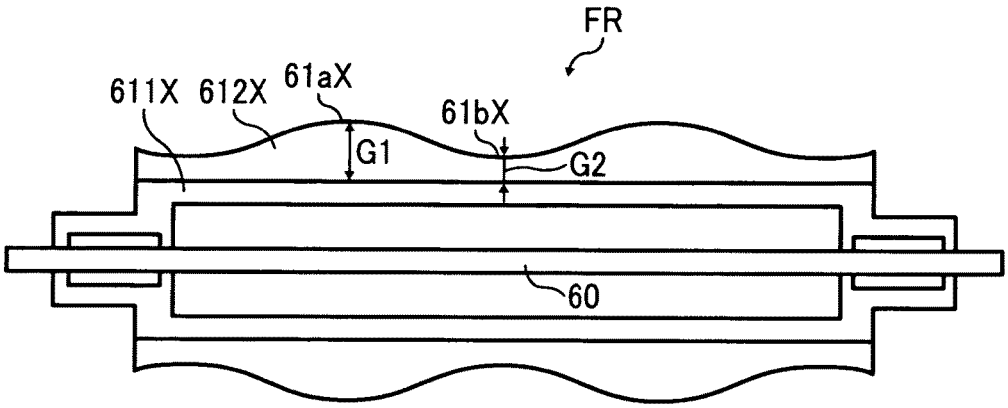
FIG. 32 is a schematic diagram illustrating a fixing roller according to a comparative example.
Figure 33:
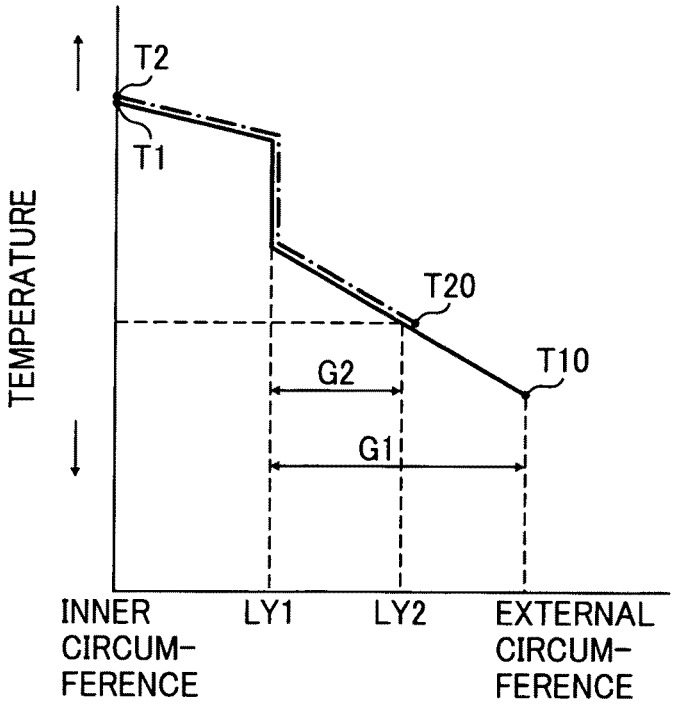
FIG. 33 is a graph illustrating differences in the surface temperature between the crown portion and the inverted-crown portion.

FIG. 32 illustrates a comparative example 4 in which the fixing roller FR has a metal core 611X whose thickness is uniform and an elastic layer 612X whose thickness is uneven, that is, crown portions 61*a*X and inverted-crown portions 61*b*X are formed in the elastic layer 612X, and a single heat lamp 60 is used to heat the fixing roller FR. FIG. 33 illustrates changes in temperature at a thickest position having a maximum thickness G1 in the crown portion 61*a*X and a thinnest position having a minimum thickness G2 in the inverted-crown portion 61*b*X when the heat lamp 60 uniformly heats an inner circumferential surface of the fixing roller FR. In FIG. 33, a vertical axis represents temperature, and a horizontal axis represents the distance from the inner circumference to the external circumference in the fixing roller FR. Reference characters LY1 represents the border between the metal core 611X and the elastic layer 612X and LY2 represents an external surface of the inverted-crown portion 61*b*X, a solid line represents the temperature of the crown portion 61*a*X, and alternate long and short lines represent the temperature of the inverted-crown portion 61*b*X.

When the inner circumferential surface of the fixing roller FR is heated uniformly, a temperature T1 on an inner surface of the crown portion 61*a*X is substantially similar to a temperature T2 on an inner surface of the inverted-crown portion 61*b*X as shown in FIG. 33. However, because the elastic layer 612X is thicker in the crown portion 61*a*X than in the inverted-crown portion 61*b*X (G1>G2), temperature decreases greater in the crown portion 61*a*X while the heat is transmitted to the external circumference. Consequently, a temperature T10 on the external surface of the crown portion 61*a*X is lower than a temperature T20 on the external surface of the inverted-crown portion 61*b*X.

Figure 34:
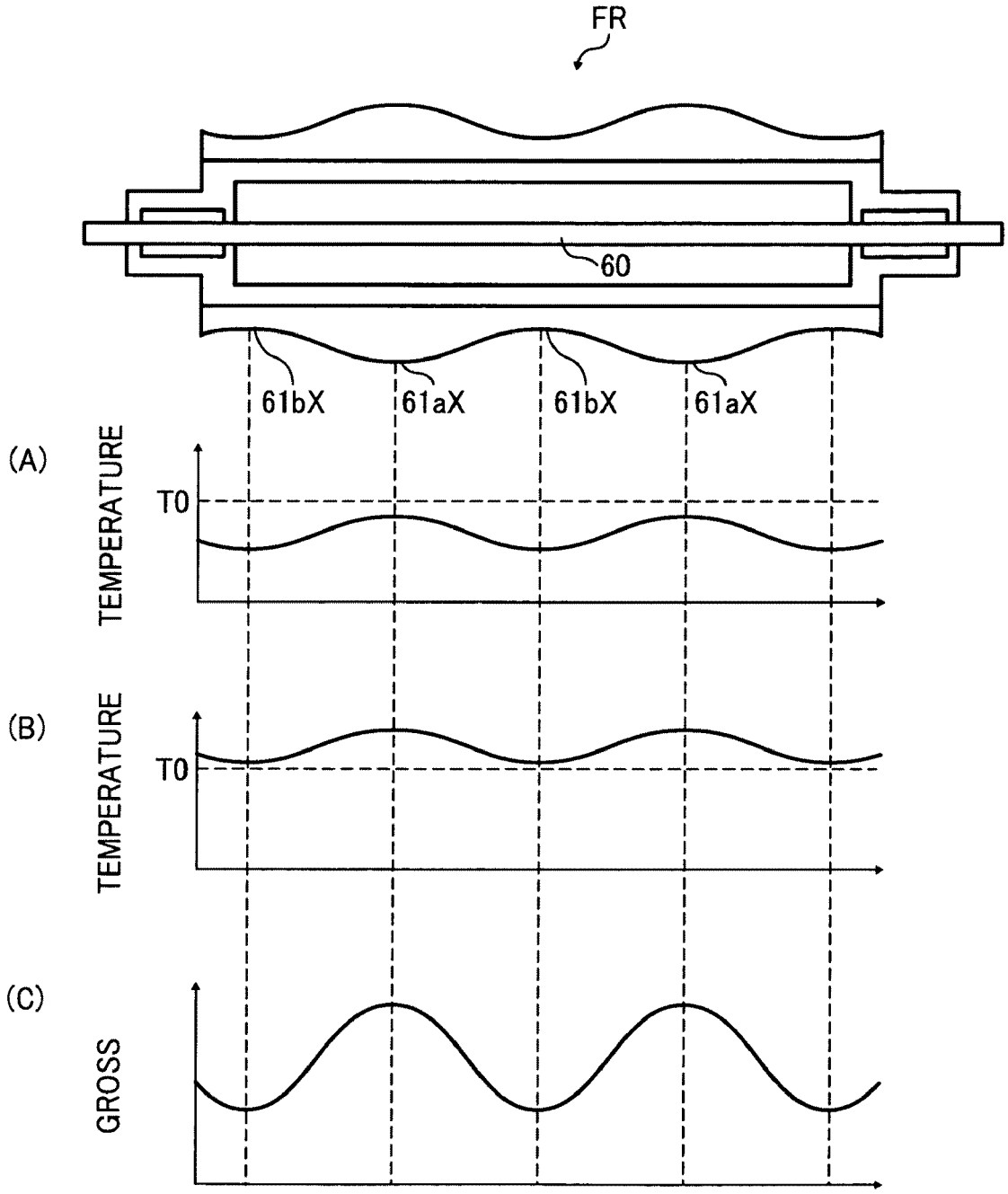
FIG. 34 illustrates differences in the surface temperature between the crown portion and the inverted-crown portion in the comparative example shown in FIG. 32.

Additionally, FIG. 34 illustrates the relation between changes in the surface temperature of the fixing roller FR in which the fixing roller 61X is heated by the single heat lamp 60 and fluctuations in gross in the image fixed by the fixing roller FR.

In FIG. 34, (A) is a graph of the surface temperature of the fixing roller FR immediately after the sheet has passed through the fixing nip, (B) is graph of the surface temperature of the fixing roller FR after the fixing roller FR is heated to compensate for the heat loss in the fixing process, and (C) illustrates unevenness in the gross of fixed image in the axial direction of the fixing roller FR.

The sheet passing through the fixing nip draws heat from the fixing roller FR. At that time, the surface temperature decreases greatly in the inverted-crown portion 61*b*X than in the crown portion 61*a*X, and the difference between a target temperature T0 and the surface temperature is larger in the inverted-crown portion 61*b*X than in the crown portion 61*a*X as shown in graph (A) in FIG. 34. Subsequently, when the single heat lamp 60 heats the fixing roller FR to raise its surface temperature to the target temperature TO, the surface temperature rises excessively in the crown portion 61*a*X from which less heat has been drawn by the sheet, and the surface temperature of the fixing roller FR becomes uneven in the axial direction as shown in graph (B) in FIG. 34. If the surface temperature is thus different between the crown portions 61*a*X and the inverted-crown portions 61*b*X, the gross of the fixed image is uneven as shown in graph (C) in FIG. 34, degrading image quality. It is to be noted that, although fluctuates in the surface temperature of the fixing roller FR are also caused when the thickness of the metal core 611X (shown in FIG. 32) is not uniform, fluctuations in the surface temperature of the fixing roller FR tend to be greater when the thickness of the elastic layer 612X (shown in FIG. 32) is not uniform.

Figure 35:
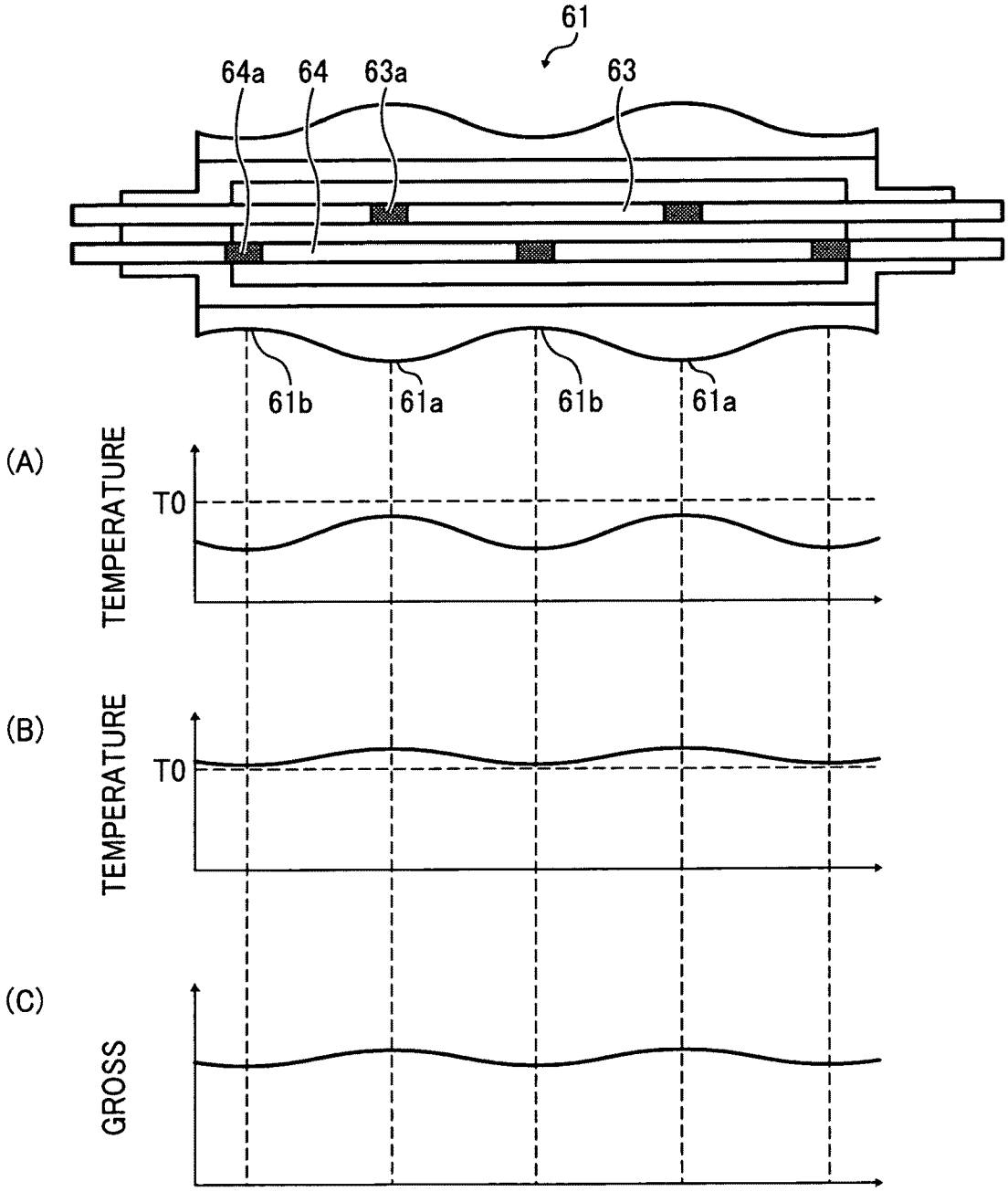
FIG. 35 illustrates reduction in differences in the surface temperature between the crown portion and the inverted-crown portion in an illustrative embodiment of the present invention.

Therefore, in the first and second embodiments, as shown in FIG. 35, the two heating members, the first heat lamp 63 and the second heat lamp 64, are provided inside the fixing roller 61, and the two heating members are controlled independently. In FIG. 35, similarly, (A) is a graph of the surface temperature of the fixing roller 61 immediately after the sheet has passed through the fixing nip, (B) is graph of the surface temperature of the fixing roller 61 after heated to compensate for the heat loss, and (C) illustrates unevenness in the gross of the fixed image.

In the fixing device 27 or 27A according to the first embodiment or the second embodiment, when the surface temperature decreases greatly in the inverted-crown portion 61*b* than in the crown portion 61*a* as shown in graph (A) shown in FIG. 35 after the sheet has passed through the fixing nip, mainly the heat generating portion 64*a* of the second heat lamp 64 is caused to generate heat. Therefore, the surface temperature is raised more significantly in the inverted-crown portion 61*b*, and fluctuations in the surface temperature in can be reduced in the axial direction of the fixing roller 61. Thus, in the first and second embodiments, unevenness in the gross of the fixed image can be reduced.

It is to be noted that, differently from the above-described method of using two heat heating members, fluctuations in the surface temperature of the fixing roller may be reduced in the comparative example in which only the single heat lamp 60 (e.g., a heating member) is provided inside the fixing roller FR if the heat generation amount can be adjusted differently between the crown portion 61*a*X and the inverted-crown portion 61*b*X. However, it is difficult to cause the single heat lamp 60 to generate heat in only a limited portion corresponding to a given portion of the fixing roller FR. By contrast, in the first and second embodiments, because at least two heating members controlled independently are provided, the amount of heat and the time period during which the heat is generated can be different between the crown portions 61*a* and the inverted-crown portions 61*b*. Therefore, the surface temperature of the fixing roller 61 can be adjusted more suitably in its axial direction.

Additionally, also in a warm-up time to heat the fixing roller 61 to a predetermined target temperature, the crown portions 61*a*, to which heat is transmitted less easily, can be heated efficiently by increasing the heat generation amount by the first heat lamp 63 from the heat generation amount by the second heat lamp 64. Therefore, the surface temperature of the fixing roller 61 can be uniform in the axial direction.

It is to be noted that the present invention is not limited to the tandem type multicolor printer shown in FIG. 2 but is applicable to monochrome image forming apparatus, copiers, facsimile machines, or multifunction machines including at least two of these functions.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device to fix a toner image on a sheet of recording media, comprising:

a cylindrical fixing member, having an external circumferential surface including at least one crown portion projecting radially outward from the surface of the fixing member and at least one inverted-crown portion curved radially inward from the surface of the fixing member, having a thickness smaller than a thickness of the crown portion;

a pressing unit including a facing surface facing the fixing member, in which at least one convexity projecting toward the fixing member and at least one concavity recessed away from the fixing member are formed, the pressing unit pressing against the fixing member while the crown portion of the fixing member matches the concavity of the pressing unit and the inverted-crown portion of the fixing member matches the convexity of the pressing unit, forming curved fixing nip therebetween, and when the fixing member and the pressing unit are in contact with each other with no pressure generated therebetween, no gaps exist between the crown portion and the inverted-crown portion of the fixing member and the concavity and the convexity of the pressing unit;

a first heating member including a first heating portion to heat the fixing member partially in an axial direction of the fixing member, the first heating portion disposed at a position corresponding to the crown portion of the fixing member in the axial direction;

a second heating member including a second heating portion to heat the fixing member partially in the axial direction of the fixing member, the second heating portion disposed at a position corresponding to the inverted-crown portion of the fixing member in the axial direction;

a temperature detecting unit to detect a surface temperature of the fixing member; and a controller to independently control the first heating member and the second heating member.

2. The fixing device according to claim 1, wherein the pressing unit comprises a pressing roller pressing against the fixing member, and the convexity and the concavity are a crown portion projecting radially outward from the surface of the pressing roller and a inverted-crown portion curved radially inward from the surface of the pressing roller, respectively.

3. The fixing device according to claim 1, wherein the pressing unit comprises:

an endless pressing belt; and a pressure member to presses an inner circumferential surface of the pressing belt, causing the pressing belt to press against the fixing member, wherein the convexity and the concavity are formed on a pressing surface of the pressure member to press against the inner circumferential surface of the pressing belt.

4. The fixing device according to claim 1, wherein, in the axial direction of the fixing member, the first heating portion is disposed at a position corresponding to an apex of the crown portion of the fixing member while the second heating portion is disposed at a position corresponding to a bottom portion of the inverted-crown portion of the fixing member.

5. The fixing device according to claim 1, wherein, an amount of heat generated by the first heating portion is greater than an amount of heat generated by the second heating portion.

6. The fixing device according to claim 1, wherein the temperature detecting unit comprises:

a first projecting-portion temperature detector disposed adjacent to the crown portion of the fixing member; and a first concavity temperature detector disposed adjacent to the inverted-crown portion of the fixing member, wherein the controller controls the first heating member and the second heating member according to the surface temperature of the fixing member detected by the first convexity-temperature detector as well as the first concavity temperature detector.

7. The fixing device according to claim 6, wherein the first projecting-portion temperature detector and the first concavity temperature detector are disposed corresponding to the crown portion and the concavity of the fixing member adjacent to each other, and the first projecting-portion temperature detector disposed at a position corresponding to an apex of the crown portion of the fixing member, and the first concavity temperature detector is disposed at a position corresponding to a bottom portion of the inverted-crown portion of the fixing member.

8. The fixing device according to claim 6, wherein the crown portion and the concavity of the fixing member are respectively formed in a center portion as well as an axial end portion in the axial direction of the fixing-member, the first projecting-portion temperature detector and the first concavity temperature detector are disposed in an axial end portion of the fixing member, and the temperature detecting unit further comprises a second projecting-portion temperature detector and a second concavity temperature detector respectively disposed adjacent to the crown portion and the inverted-crown portion in a center portion in the axial direction of the fixing-member, wherein, the controller controls the first heating member and the second heating member according to the surface temperature of the fixing member detected by the first projecting-portion temperature detector, the second projecting-portion temperature detector, the first concavity temperature detector, and the second concavity temperature detector.

9. The fixing device according to claim 8, wherein positions of first axial end portions on an identical side of the fixing member and the pressing member are fixed in the axial direction of the fixing member, second axial end portions of the fixing member and the pressing member opposite the first axial end portions are movable in the axial direction of the fixing member, and the first projecting-portion temperature detector and the first concavity temperature detector are disposed in the fixed first axial end portion of the fixing member.

10. An image forming apparatus, comprising:

an image carrier on which a latent image is formed;

a development device to develop the latent image with developer;

a transfer unit to transfer the image onto a sheet of recording media; and a fixing device including:

a cylindrical fixing member, having an external circumferential surface including at least one crown portion projecting radially outward from the surface of the fixing member and at least one inverted-crown portion curved radially inward from the surface of the fixing member, having a thickness smaller than a thickness of the crown portion;

a pressing unit including at least one convexity projecting from a facing surface facing the fixing member toward the fixing member and at least one concavity recessed away from the fixing member, formed on the facing surface;

the pressing unit pressing against the fixing member while the crown portion of the fixing member matches the concavity of the pressing unit and the inverted-crown portion of the fixing member matches the convexity of the pressing unit, forming curved fixing nip therebetween, and when the fixing member and the pressing unit are in contact with each other with no pressure generated therebetween, no gaps exist between the crown portion and the inverted-crown portion of the fixing member and the concavity and the convexity of the pressing unit, a first heating member including a first heating portion to heat the fixing member partially in an axial direction of the fixing member, the first heating portion disposed at a position corresponding to the crown portion of the fixing member in the axial direction;

a second heating member including a second heating portion to heat the fixing member partially in the axial direction of the fixing member, the second heating portion disposed at a position corresponding to the inverted-crown portion of the fixing member in the axial direction;

a temperature detector detect a surface temperature of the fixing member; and a controller to independently control the first heating member and the second heating member.

11. A fixing device to fix a toner image on a sheet of recording media, comprising:

a fixing member, having an external circumferential surface including at least one crown portion projecting radially from the surface of the fixing member and at least one inverted-crown portion curved radially inward from the surface of the fixing member;

a heat source to heat the fixing member;

a pressing unit including a facing surface facing the fixing member, in which at least one convexity projecting toward the fixing member and at least one concavity recessed away from the fixing member are formed, the pressing unit pressing against the fixing member while the crown portion of the fixing member matches the concavity of the pressing unit and the inverted-crown portion of the fixing member matches the convexity of the pressing unit, forming a curved fixing nip therebetween, and when the fixing member and the pressing unit are in contact with each other with no pressure generated therebetween, no gaps exist between the crown portion and the inverted-crown portion of the fixing member and the concavity and the convexity of the pressing unit; and a guide member to guide the sheet to the fixing nip, disposed upstream from the fixing nip in a sheet transport direction, wherein, with a virtual plane Y passing through both an axial line of the fixing member and a center of the fixing nip in the sheet transport direction and a curve reference plane perpendicular to the plane Y passing through the center of the fixing nip in the sheet transport direction, at least a downstream edge of a sheet facing surface of the guide member facing a sheet transport path in the sheet transport direction is closer to the pressing unit than the curve reference plane is.

12. The fixing device according to claim 11, wherein the pressing unit comprises a pressing roller pressing against the fixing member, and the convexity and the concavity are a crown portion projecting radially outward from the surface of the pressing roller and a inverted-crown portion curved radially inward from the surface of the pressing roller, respectively.

13. The fixing device according to claim 12, wherein a downstream edge surface of the guide member perpendicular to the sheet transport direction is curved to conform substantially to the shape of the external circumference of the pressing roller.

14. The fixing device according to claim 13, wherein the distance between the fixing roller and the downstream edge surface of the guide member is uniform.

15. The fixing device according to claim 11, wherein the pressing unit comprises:

an endless pressing belt; and a pressure member to presses an inner circumferential surface of the pressing belt, causing the pressing belt to press against the fixing member, wherein the concavity and the convexity are formed on a pressing surface of the pressure member to press against the inner circumferential surface of the pressing belt.

16. The fixing device according to claim 11, wherein the sheet facing surface of the guide member has a shape that conforms substantially to a shape of the curved fixing nip, and the downstream edge of the curved sheet facing surface of the guide member in the sheet transport direction is closer to the pressing unit than the curve reference plane.

17. The fixing device according to claim 11, wherein the guide member comprises multiple projections projecting toward the sheet transport path from the sheet facing surface, extending in the sheet transport direction, wherein the multiple projections are arranged in the axial direction of the fixing member, a virtual plane passing through apexes of the respective projections conforms substantially to the shape of the curved fixing nip, and a downstream edge of a respective one of the multiple projections in the sheet transport direction is closer to the pressing unit than the curve reference plane.

18. The fixing device according to claim 11, wherein a downstream edge portion of the guide member in the sheet transport direction is edgeless in a cross section perpendicular to the axial line of the fixing member.

19. The fixing device according to claim 11, wherein a downstream edge portion of the guide member in the sheet transport direction is partly in contact with the pressing unit.

20. The fixing device according to claim 11, wherein the guide member has an electrical resistivity capable of preventing leakage of a transfer current to transfer the image onto the sheet.

* * * * *